US008608341B2

(12) United States Patent
Boomgaarden et al.

(10) Patent No.: US 8,608,341 B2
(45) Date of Patent: Dec. 17, 2013

(54) LED LUMINAIRE

(75) Inventors: Mark Penley Boomgaarden, Indian Harbour Beach, FL (US); Shane Sullivan, Indialantic, FL (US); Ryan Chase Kelley, Centennial, CO (US); David Henderson, Indialantic, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 127 days.

(21) Appl. No.: 13/336,216

(22) Filed: Dec. 23, 2011

(65) Prior Publication Data

US 2012/0230027 A1 Sep. 13, 2012

Related U.S. Application Data

(63) Continuation-in-part of application No. 13/041,877, filed on Mar. 7, 2011.

(51) Int. Cl.
*F21S 4/00* (2006.01)

(52) U.S. Cl.
USPC ..... 362/249.02; 362/249.01; 362/294; 362/307

(58) Field of Classification Search
USPC ..... 362/230, 231, 235, 236, 240, 241, 244, 362/245, 249.01, 249.02, 249.06, 294, 362/296.01, 297, 307, 308, 310, 329, 341, 362/346, 347, 373, 470, 800; 313/113, 313/498–501
See application file for complete search history.

(56) References Cited

U.S. PATENT DOCUMENTS

| | | | |
|---|---|---|---|
| 6,220,722 | B1 | 4/2001 | Begemann |
| 6,364,506 | B1 | 4/2002 | Gallo |
| 6,452,217 | B1 | 9/2002 | Wojnarowski et al. |
| 6,621,222 | B1 | 9/2003 | Hong |
| 7,344,279 | B2 | 3/2008 | Mueller et al. |

(Continued)

FOREIGN PATENT DOCUMENTS

| | | | |
|---|---|---|---|
| GB | 2350176 | | 11/2000 |
| JP | 2004296245 | A * | 10/2004 |

(Continued)

OTHER PUBLICATIONS

International Search Report mailed Oct. 12, 2012 for International Application Serial No. PCT/US2012/027712; International filing date Mar. 5, 2012.

(Continued)

*Primary Examiner* — Hargobind S Sawhney
(74) *Attorney, Agent, or Firm* — Cantor Colburn LLP

(57) ABSTRACT

Disclosed is a luminaire including an electrical base, a driver circuit in electrical communication with the electrical base, a heat sink operably coupled to the electrical base, a lens coupled to the heat sink and having a first portion adjacent the heat sink and a second portion adjacent the first portion, the first portion having at least one aperture disposed therein or therethrough, the at least one aperture having a different optical transmission property from the first portion in which the at least one aperture is disposed, a reflective member between the second portion and the heat sink, and an LED light source between the reflective member and the heat sink, the LED having at least one LED member between the reflective member and the first portion to emit light towards the reflective member, each LED member being disposed in electrical communication with the driver circuit.

23 Claims, 36 Drawing Sheets

(56) References Cited

U.S. PATENT DOCUMENTS

| | | | | |
|---|---|---|---|---|
| 7,960,872 | B1 | 6/2011 | Zhai et al. | |
| 8,047,679 | B2 | 11/2011 | Wu et al. | |
| 8,125,127 | B2 | 2/2012 | Mo et al. | |
| 8,143,769 | B2 * | 3/2012 | Li | 313/46 |
| 8,227,968 | B2 | 7/2012 | Kaandorp et al. | |
| 8,287,147 | B2 | 10/2012 | Tian et al. | |
| 8,324,789 | B2 | 12/2012 | Hisayasu et al. | |
| 8,342,719 | B2 | 1/2013 | Takase et al. | |
| 2004/0057252 | A1 | 3/2004 | Coushaine | |
| 2005/0068777 | A1 | 3/2005 | Popovic | |
| 2005/0110649 | A1 | 5/2005 | Fredericks et al. | |
| 2006/0274529 | A1 | 12/2006 | Cao | |
| 2007/0002572 | A1 | 1/2007 | Ewig et al. | |
| 2010/0002432 | A1 | 1/2010 | Romano | |
| 2010/0026157 | A1 | 2/2010 | Tanaka et al. | |
| 2010/0027281 | A1 | 2/2010 | Waters et al. | |
| 2010/0207534 | A1 | 8/2010 | Dowling et al. | |
| 2010/0219735 | A1 | 9/2010 | Sakai et al. | |
| 2010/0259916 | A1 | 10/2010 | Sun | |
| 2011/0006658 | A1 | 1/2011 | Chan et al. | |
| 2012/0161626 | A1 | 6/2012 | van de Ven et al. | |

FOREIGN PATENT DOCUMENTS

| | | |
|---|---|---|
| JP | 2005044766 | 2/2005 |
| KR | 100927114 | 11/2009 |
| KR | 200448865 | 5/2010 |
| WO | 2010117174 | 10/2010 |
| WO | WO 2011042357 A1 * | 4/2011 |

OTHER PUBLICATIONS

Written Opinion of the International Searching Authority mailed Oct. 12, 2012 for International Application Serial No. PCT/US2012/027712; International filing date Mar. 5, 2012.

International Preliminary Report on Patentability for International Application PCT/US2012/027712 filing date Mar. 5, 2012; report issued Sep. 10, 2013. Referenced art cited previously.

* cited by examiner

LED LUMINAIRE

CROSS REFERENCE TO RELATED APPLICATIONS

This application is a continuation in parts of U.S. patent application Ser. No. 13/041,877 filed on Mar. 7, 2011, which is herein incorporated by reference in its entirety.

BACKGROUND OF THE INVENTION

The subject matter disclosed herein relates generally to a luminaire having an LED light source, particularly to an LED luminaire sized to replace an incandescent light bulb, and more particularly to an LED luminaire sized to replace an A19 incandescent light bulb.

In recent years, there has been an increased interest in luminaires, sometimes referred to as "light bulbs" or lamps, which use light emitting diodes ("LEDs") as a light source. These luminaires are quite attractive since they overcome many of the disadvantages of the conventional light sources, which include incandescent light bulbs, fluorescent, halogen and metal halide lamps.

Conventional light sources, such as incandescent lamps for example, typically have a short useful life. As such, lighting systems commonly incorporate a fixture or "socket" that allows the lamps to be interchanged when the lamp fails to operate. One type of socket, sometimes known as the E25 or E26 Edison medium base, meets the criteria set by the American National Standards Institute (ANSI), such as the ANSI C78.20-2003 standard for 60 Watt A19 type lamps. The wide adoption of this standard allows the interchangeability of lamps from a variety of manufacturers into lighting systems.

Luminaires have been proposed that allow the use of LED devices in lighting systems. However, LED luminaires tend to emit light in a more directional manner than a corresponding incandescent light bulb. Incandescent light bulbs typically emit light at a substantially uniform luminous intensity level in all directions (360 degree spherical arc about the filament). Thus an incandescent A19 lamp in a luminiaire for example emits substantially the same amount of light outwardly into the room and as it does in a perpendicular direction, or downward toward the surface that the luminaire is resting. This provides for both general ambient lighting and task lighting in a single lamp. An LED module in a luminaire by contrast typically emits light over a cone of 120-150 degrees. As a result, the LED luminaire, even one which is arranged within a globe shaped optic, will not have an equal distribution of light and some areas will have higher luminous intensity than others.

Accordingly, while existing LED luminaires are suitable for their intended purposes, improvements may be made in increasing the ability of the luminaire to distribute light more uniformly, while also providing a direct replacement for conventional incandescent A-lamps.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

In accordance with one embodiment of the invention, a luminaire is provided and includes an electrical base, a driver circuit in electrical communication with the electrical base, a heat sink operably coupled to the electrical base, a lens coupled to the heat sink, the lens having a first portion adjacent the heat sink and a second portion adjacent the first portion, the first portion having at least one aperture disposed therein or therethrough, the at least one aperture having a different optical transmission property from the first portion in which the at least one aperture is disposed, a reflective member disposed between the second portion and the heat sink, and a light emitting diode (LED) light source disposed between the reflective member and the heat sink, the LED light source having at least one LED member arranged between the reflective member and the first portion to emit at least a portion of light towards the reflective member, each LED member being disposed in electrical communication with the driver circuit.

Another embodiment of the invention includes a luminaire including an electrical base, a heat sink having a plurality of ribs coupled to the electrical base, a lens coupled to the heat sink, the lens having a first portion adjacent the heat sink and a second portion adjacent the first portion opposite the heat sink, the first portion having a plurality of apertures disposed circumferentially about the first portion, wherein each of the plurality of apertures is disposed to direct light substantially between each of the ribs in the plurality of ribs, a frustoconical or toroidal member having a first end adjacent the heat sink and a second end adjacent the second curved portion, and a light emitting diode (LED) light source disposed adjacent the first end and the heat sink, the LED light source having at least one LED member arranged between the first end and the first portion and arranged to emit at least a portion of light towards the frustoconical member.

Another embodiment of the invention includes a luminaire including a heat sink having a plurality of ribs disposed about a circumference, an LED light source disposed on one end of the heat sink, the LED light source having a plurality of LED modules disposed on a radius about a longitudinal axis of the heat sink, a lens coupled to the heat sink, the lens having a first portion and a second portion adjacent the first portion, the first portion having at least one aperture, the at least one aperture having a higher optical transmissivity than the first portion, a member disposed between the lens and the LED light source, wherein the member has a reflective outer surface disposed between the plurality of LED modules and the lens, and wherein at least the reflective outer surface, the first curved portion, and the at least one aperture cooperate to distribute light emitted from the LED light source with a substantially even luminous intensity around a perimeter of the lens.

BRIEF DESCRIPTION OF THE DRAWINGS

Referring to the exemplary drawings wherein like elements are numbered alike in the accompanying Figures.

Figure 1:
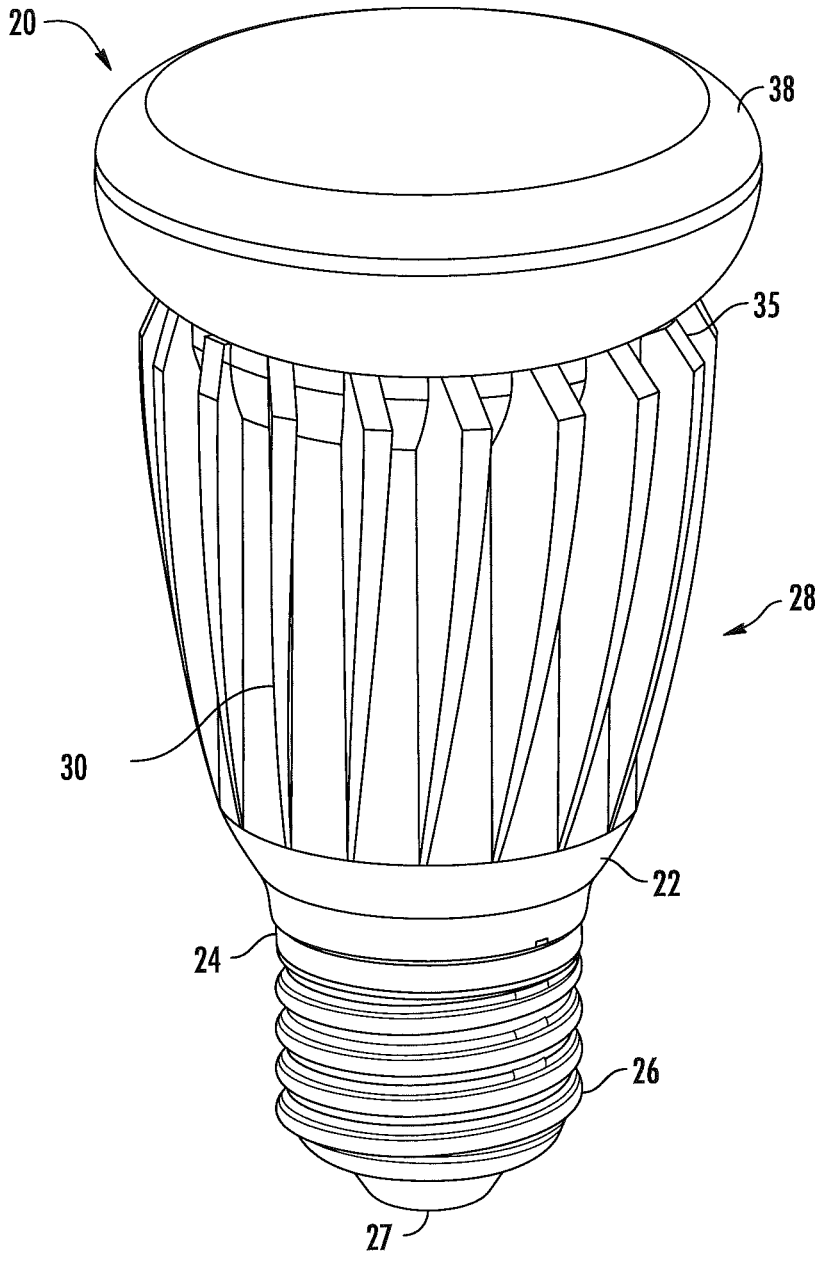
FIG. 1 is a perspective view illustration of a luminaire in accordance with an embodiment of the invention.
Figure 2:
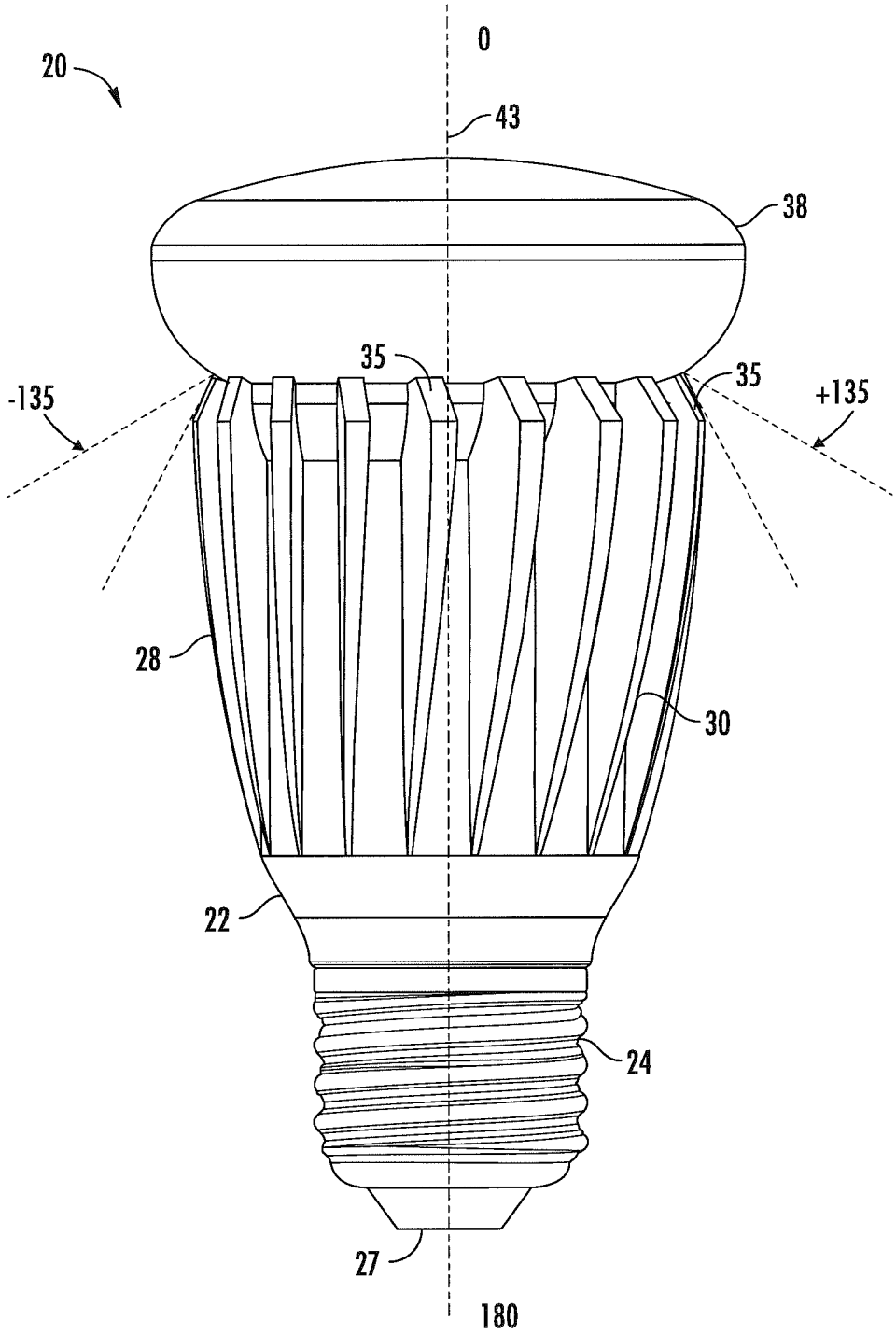
FIG. 2 is side plan view illustration of the luminaire of FIG. 1.
Figure 3:
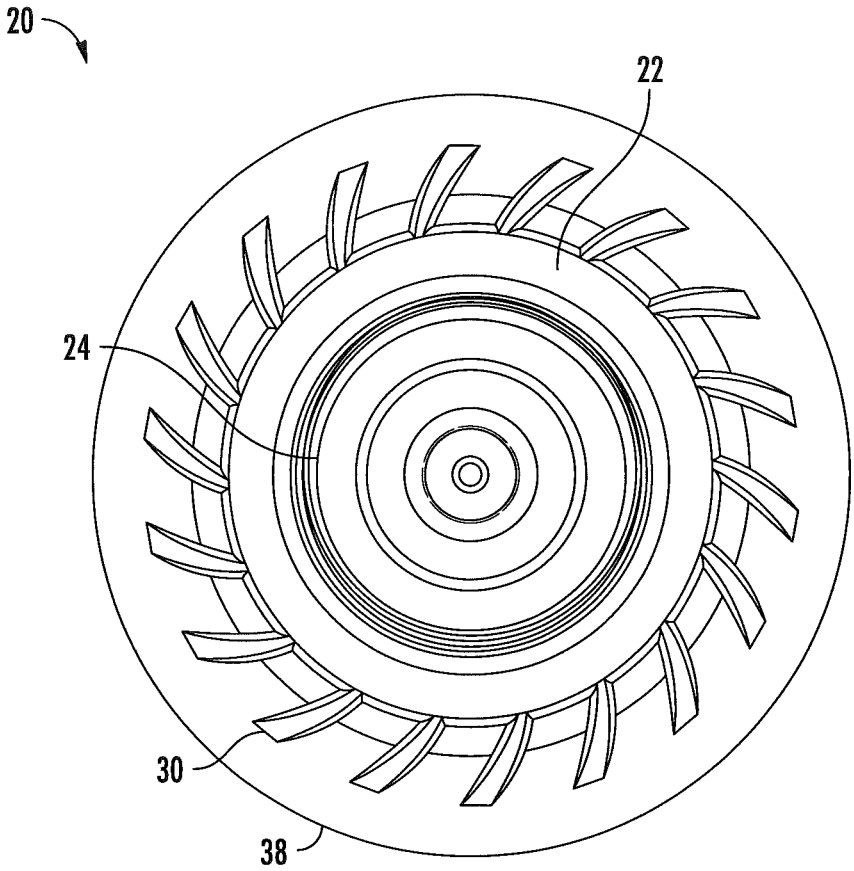
FIG. 3 is a bottom plan view illustration of the luminaire of FIG. 1.
Figure 4:
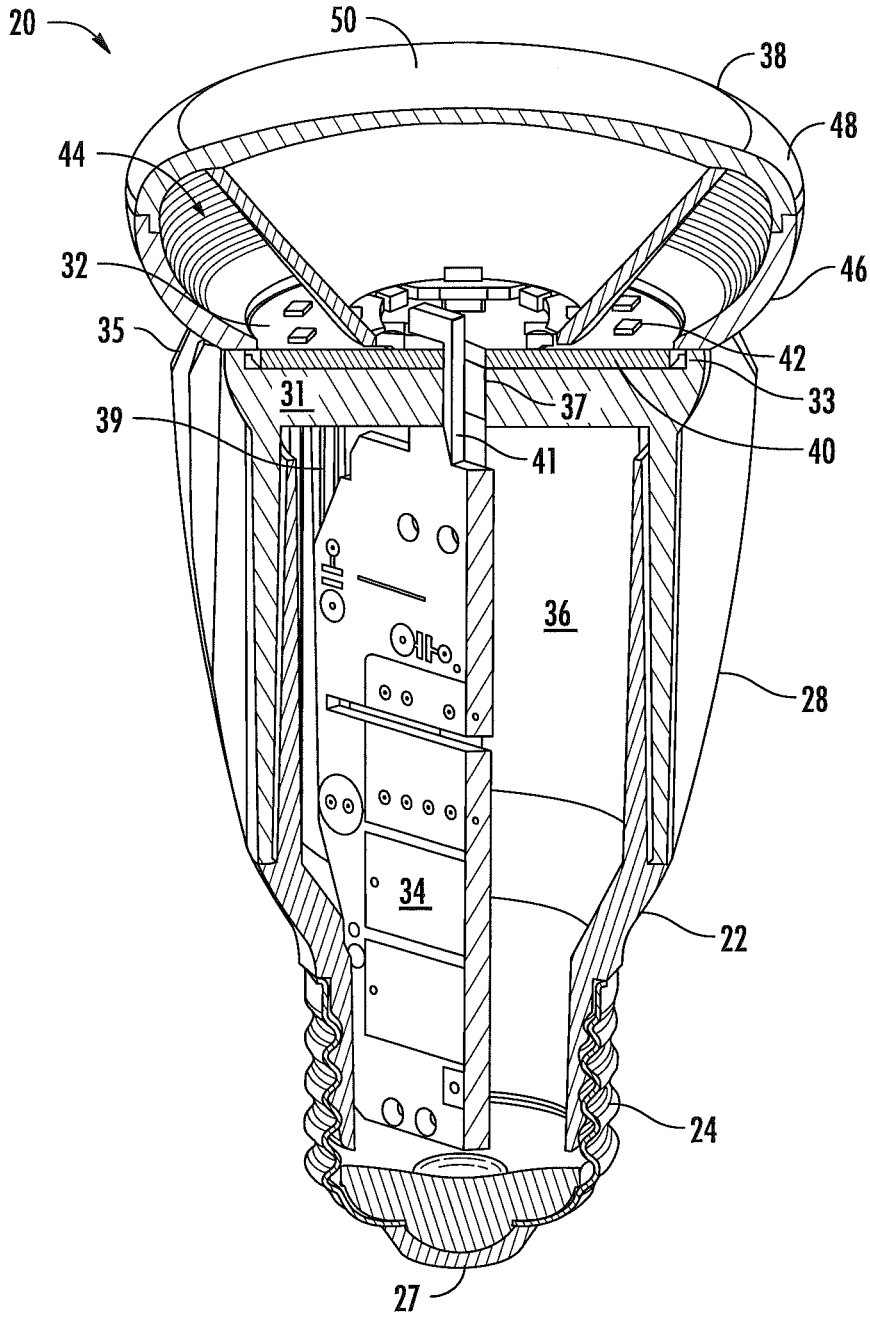
FIG. 4 is a perspective view illustration, partially in section, of the luminaire of FIG. 1.

The detailed description explains embodiments of the invention, together with advantages and features, by way of example with reference to the drawings.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

An embodiment of the invention, as shown and described by the various figures and accompanying text, provides a luminaire with light emitting diodes (LEDs) that is suitable for replacing a standard A19 lamp, such as that defined by ANSI 078.20-2003 for example, equipped with a threaded connector, sized and shaped as an Edison E26 medium base defined by ANSI C81.61-2007 or IEC standard 60061-1 (7004-21A-2) for example, suitable to be received in a standard electric light socket, where the driver circuit for the luminaire is self-contained within the A19 profile and may be dimmable. Further, the luminaire may operate in compliance with energy efficiency standards, such as the Energy Star Program Requirements for Integral LED Lamps for example.

While an embodiment of the invention described herein depicts an A19 lamp, it be appreciated that the scope of the invention is not so limited, and also encompasses other types and profiles of light bulbs, such as but not limited to G-shaped, A-shaped and P-shaped lamps for example.

While an embodiment described herein depicts a certain topology of circuit components for driving the LEDs, it should be appreciated that the disclosed invention also encompasses other circuit topologies falling within the scope of the claims. It should also be appreciated that while embodiments disclosed herein describe the claimed invention in terms of an A19 lamp envelope or an Edison E26 medium base, the claimed invention is not necessarily so limited.

FIGS. 1-6 depict an exemplary LED luminaire 20 having an intermediate member 22 with an Edison type base 24 (alternatively herein referred to as an electrical connector) with appropriately sized threads 26 sized and shaped to be received in a standard electric light socket. An electrical contact 27 is disposed on one end of the base 24. In an embodiment, base 24 is an Edison E26 medium base. Coupled to the intermediate member 22 is a heat sink 28 that includes a plurality of ribs 30. Heat sink 28 is in thermal communication with an LED light source 32 to allow dissipation of thermal energy from the luminaire 20.

The heat sink 28 includes an interior portion that is sized to receive the intermediate member 22. One end 31 includes a recess 33 that receives the LED light source 32. The end 31 may further include a slot 37 that extends into the interior portion. The plurality of ribs 30 are disposed about the outer circumference of the heat sink 28. In one embodiment, the ribs 30 extend along the length of the heat sink 28 and include a straight, curved or helix profile. In the exemplary embodiment, each rib 30 includes an angled surface 35 on an end adjacent the LED light source 32. In one embodiment, the angled surface 35 is disposed at an obtuse angle greater the 135° from the longitudinal vertical axis of the luminaire 20. As will be discussed in more detail below, the angled surface 35 provides advantages in allowing a portion of the light to be distributed in a direction toward the base 24. In one embodiment, the heat sink 28 is made from a metal, such as aluminum for example, or a thermally conductive polymer.

A circuit driver 34 is arranged within an interior portion 34 of intermediate member 22. In one embodiment, intermediate member 22 includes a slot or groove 39 that is sized to receive and retain one edge of the circuit driver 34. One end of the circuit driver 34 includes a tab member 41 that extends through the slot 37. The circuit driver 34 is electrically coupled between the base 24 and the light source 32 to control and provide the desired amount of electrical power to generate light. A lens 38 having a substantially hollow interior 44 is disposed about the light source 32 and couples to the heat sink 28. As will be discussed in more detail below, the lens 38 forms a luminous ring that further disperses the light emitted by the light source 32 to provide a distribution of light having substantially even luminous intensity about the longitudinal axis 43 of the luminaire 20. In an embodiment, the lens 38 is made from a molded polycarbonate or glass material. Alternatively, the lens 38 may include crystalline particulate material, such as borosilicate for example, that is molded into the material. In some embodiments, the lens 38 may also have a variable density, such as by forming the lens 38 in a multistage molding process. The crystalline particulate material and/or variable density increase the amount of diffusion and allows for beam shaping of the emitted light. In some embodiments, the lens 38 is frosted with a surface treatment or fabricated with a pigment or additive to have a diffuse white transmissive appearance.

In the exemplary embodiment, the lens 38 includes a first portion 46 having a first curvature, a second portion 48 having a second curvature and a third portion 50. In one embodiment, the first portion 46 and the second portion 38 are molded separately and ultrasonically welded together. In another embodiment, the portions 46, 48, 50 are formed as a single piece. In yet another embodiment, the third portion 50 is an opening.

The light source 32 includes a circuit board 40 having a plurality of LED chips or modules 42 mounted thereon. In an example embodiment, the LED modules 40 are lambertian emitters that may or may not include primary optics or multiple die in a single package. One embodiment may be 1.7-$mm^2$ die with a primary optic that creates a 120-degree beam angle (still emits light to a full 180 degrees e.g. not limited to only a 120-degree arc). In another embodiment the LED modules 40 may include multiple small die in a single package with no primary optics that are nearly lambertian emitters. In another embodiment, the LED modules 40 are configured to emit light over a 150-degree arc. In an example embodiment, the light source 32 is a 3.3-volt to 13-volt system. In operation, the driver circuit 34 outputs a signal, analogous to a DC electrical current, to the circuit board 40. The circuit board 40 distributes the signal to the LED modules 42. In response to this signal, the LED modules 42 generate photons of light that are directed into the lens 38, which diffuses the photons to illuminate the desired area. In the exemplary embodiment, the LED modules 42 are mounted to the circuit board 40 in a manner that the light from the LED modules 42 is oriented in the same direction (e.g. parallel to the axis 43).

The circuit board 40 may be substantially circular with central slot 37. In another embodiment, the circuit board 40 is ring shaped with an central opening sized to receive a reflector member 52. In yet another embodiment, the LED modules 42 are arranged in a chip-on-board configuration wherein the LED modules 42 are packaged as an integral component of the circuit board 40.

The luminaire 20 further includes a reflector member 52 disposed between the third portion 50 and the circuit board 40. In the exemplary embodiment, the member 52 has a frustoconical, toroidal, or cone shape. The reflector member 52 may be made from a suitable opaque material having a reflective outer surface arranged opposite the LED modules 42. The reflector member 52 may be made from a highly reflective and mostly diffuse material. In the exemplary embodiment, the reflector member 52 is a made from high diffuse reflectance film, such as White97 film manufactured by WhiteOptics, LLC for example, and thermoformed into the proper geometry. The reflector member 52 includes a wall portion 58 and an end 60 adjacent the circuit board 40. In one embodiment, the end 60 includes a plurality of tabs 62. The tabs 62 engage openings 64 in the circuit board 40 and openings 66 in the end 31 of heat sink 28. The tabs 62 are arranged in a snap-fit into the openings 64, 66 to couple the reflective member 52 to the heat sink 28. It should be appreciated that while the embodiments herein describe the reflector member 52 as reflecting a substantial portion of the light, this is for exemplary purposes only and the reflector member 52 may allow for a limited amount of transmittance of light through the wall portion 58.

Figure 9A:
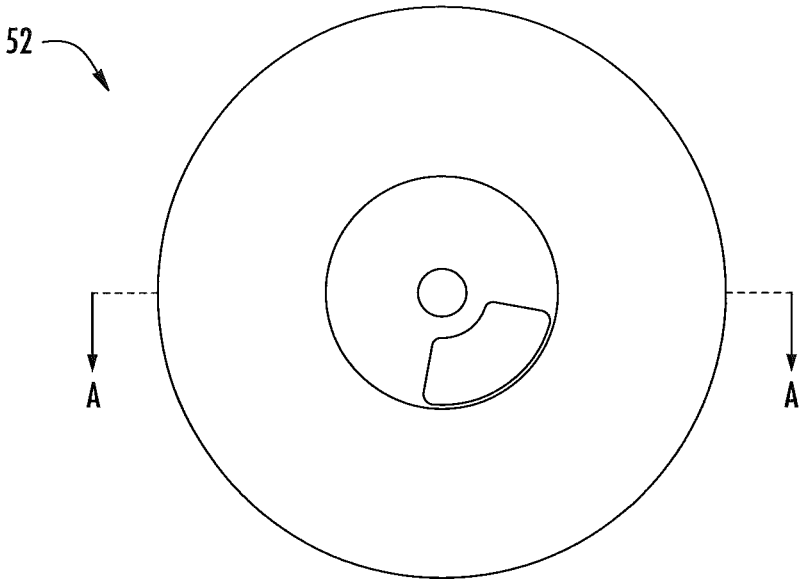
FIG. 9A and FIG. 9B are an illustration of the reflective member of FIGS. 4-6.
Figure 9B:
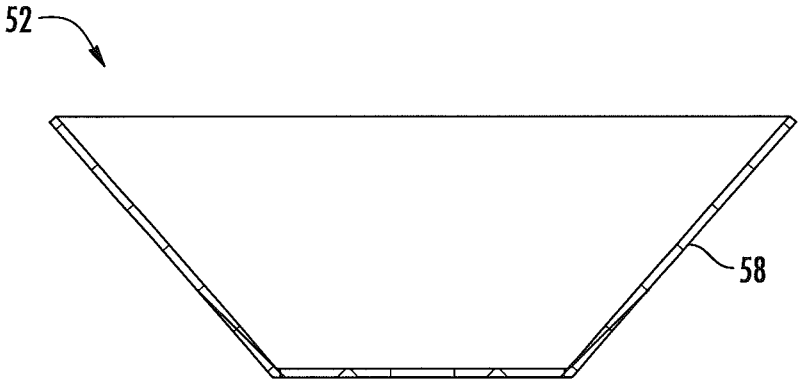

One embodiment of the reflector member 52 is shown in FIGS. 9A-9B. In this embodiment, the reflector member 52 outer wall 58 is a frustoconical shape having a 49 degree angle. The wall 58 has a 0.7-inch diameter adjacent the LED light source 32.

Figure 5:
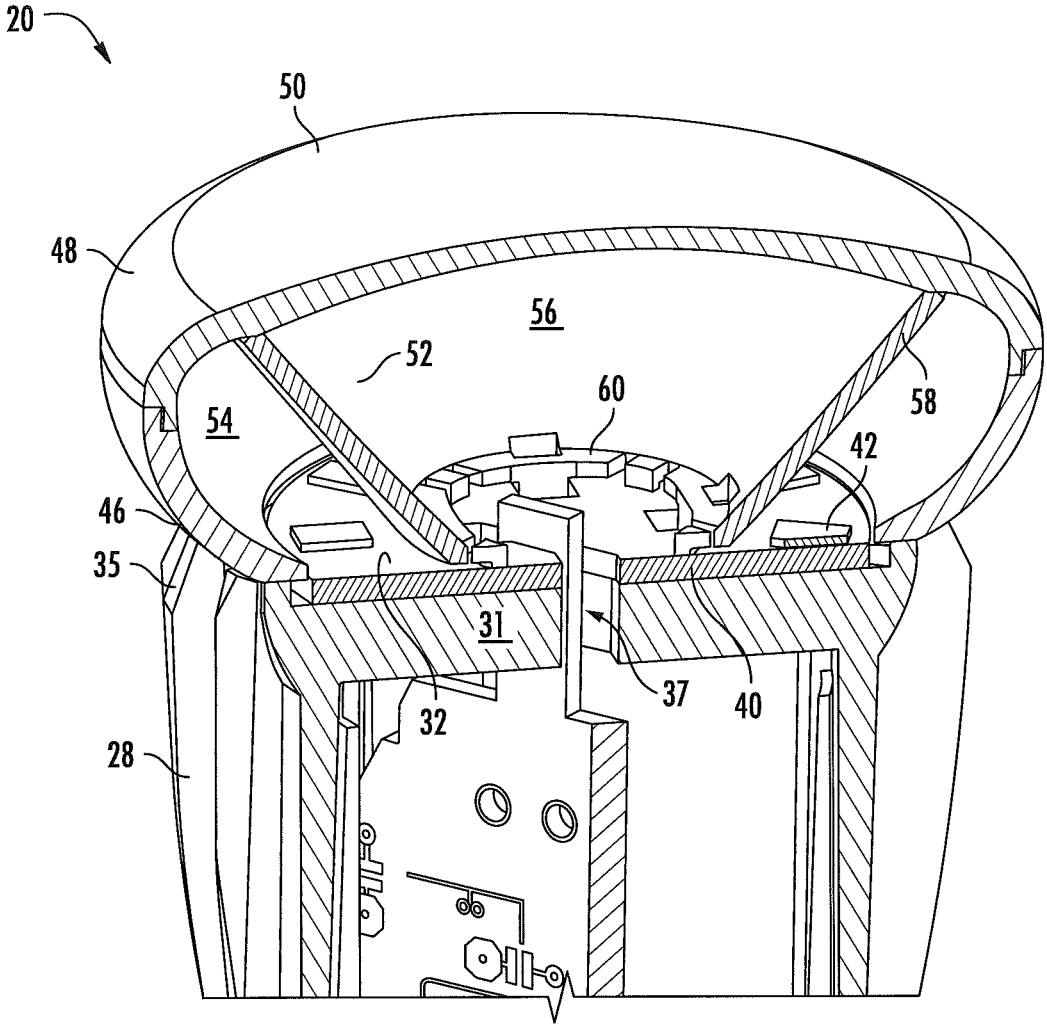
FIG. 5 is a partial enlarged perspective view illustration, partially in section, of the luminaire of FIG. 1.
Figure 6:
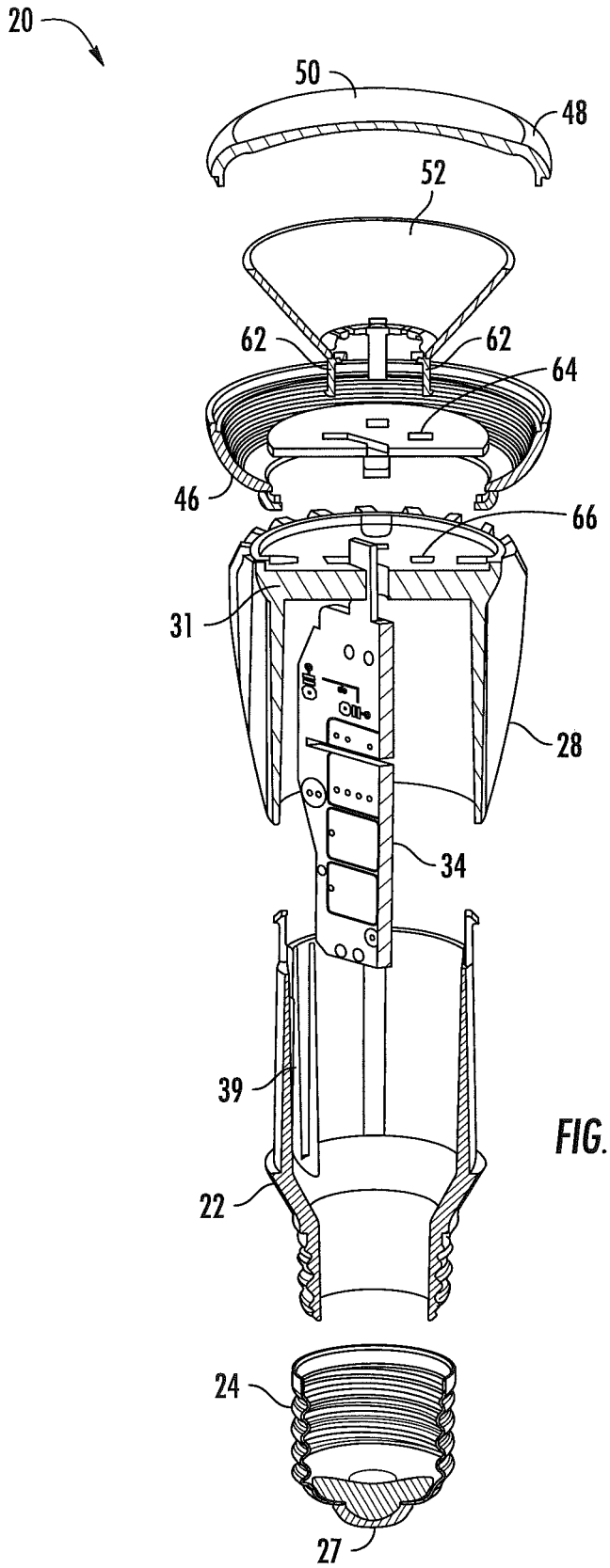
FIG. 6 is an exploded view illustration, partially in section of the luminaire of FIG. 1.

It should be appreciated that the reflector member 52 bifurcates the interior 44 into outer area 54 and an inner area 56 (FIG. 5). The LED modules 42 are arranged on the circuit board 40 in the outer area 54 such that the wall portion 58 is disposed between the LED modules 42 and the third portion 50. In other, the reflector member 52 is arranged such that the LED modules 42 will not directly emit light in an axial direction from the region of the third portion 50. The reflective outer surface of reflector member 52 redirects the emitted light from the LED modules 42 toward the lens 38. Upon entering the lens 38, the light is further diffused with a portion of the light passing through the lens 38 and a portion reflecting back and passing out another portion of the lens 38. In the exemplary embodiment, the curvature of wall 58, the curvature of portions 46, 48 and the light emission angle of the LED modules 42 cooperate to diffuse the light about the luminaire 20. The candela from vertical angles of 0 to 135 may be substantially equal, and the candela distribution may be substantially axially symmetric (all horizontal angles have substantially equal candela at a given vertical angle).

The shape of the lens 38 is configured such that with a diffuse uniformly luminous material, the exposed luminous areas from substantially every view angle is equal so that the luminous intensity distribution is substantially the same from a vertical angle of 0-135 degrees. In other words, an equal luminous area is shown to each angle in the light distribution It should further be appreciated that in the exemplary embodiment, substantially no light is transferred through the inner area 56. Therefore, light distributed in the axial direction results from light that is reflected off the first portion 46 at vector that passes through the second portion 48 into an area adjacent the third portion 50. This provides advantages in maintaining an even level of luminous intensity of light when viewed from an axial direction as when viewed from a side of the luminaire 20. In other words, a user looking at the luminaire 20 will see substantially similar uniformity of luminous intensity from the LED generated light as the user would see from a traditional incandescent lamp. This arrangement allows for mixing of multiple reflections that provides additional advantages in improving color uniformity. Further, the mixing and diffusion of the light helps provide a desirable color and hides the view of the LED modules 42.

In one embodiment, the luminaire 20 has an even luminous intensity (candelas) within a 0° to 135° zone (FIG. 2) and is vertically axially symmetrical. In one embodiment, the luminous intensity does not differ more than +/−20% within a 0° to 135° zone. In yet another embodiment, greater than or equal to 5% of the luminous flux (lumens) is distributed within the 135°-180° zone.

Figure 7:
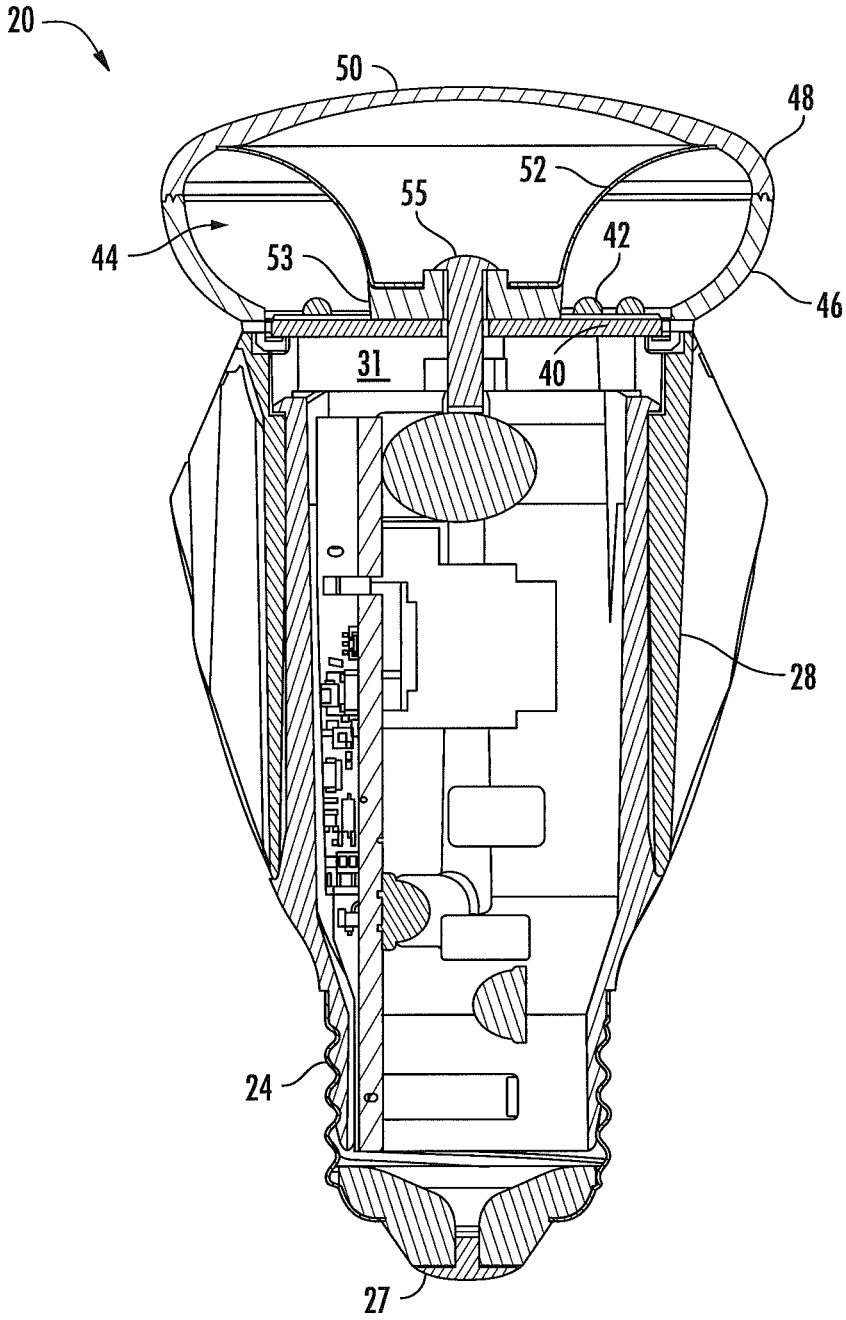
FIG. 7 is a sectional view illustration of another embodiment of the luminaire of FIG. 1.
Figure 8A:
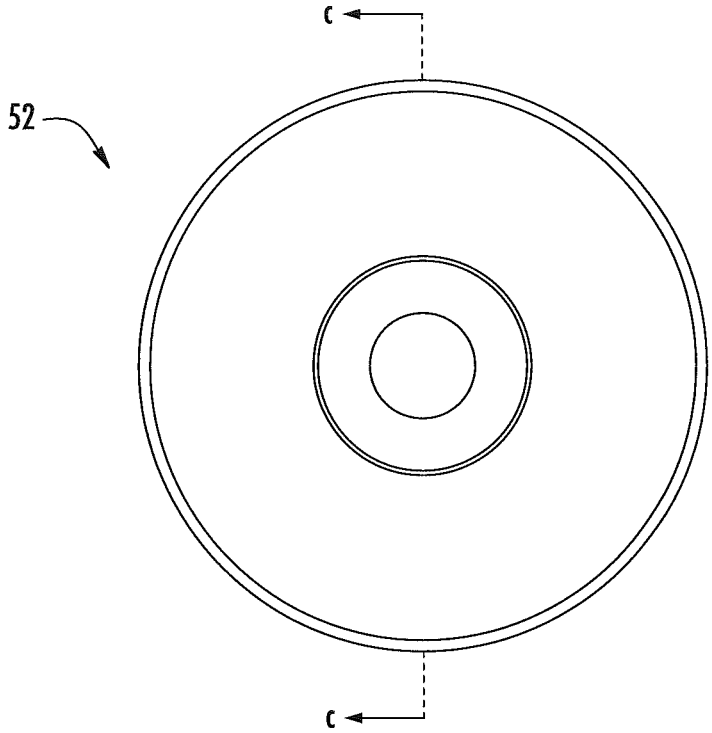
FIG. 8A and FIG. 8B are an illustration of the reflective member of FIG. 7.
Figure 8B:
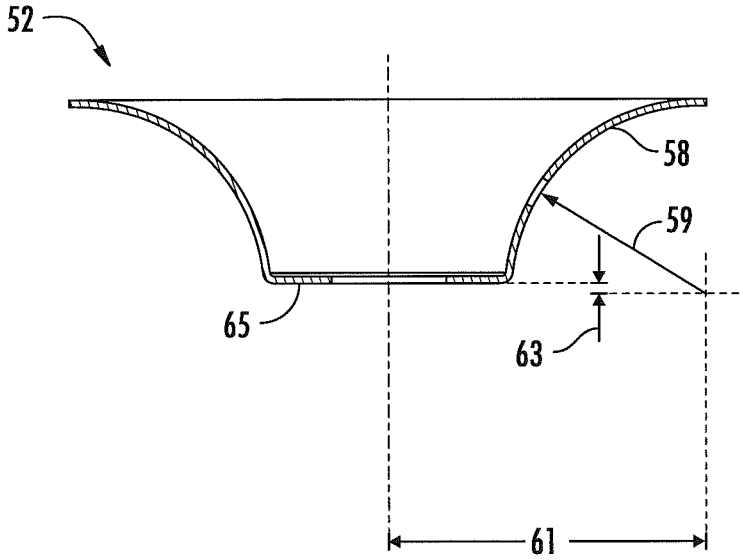

In one embodiment shown in FIGS. 7 and 8A-8B, the luminaire 20 includes a reflector member 52 having a toroidal or curved outer wall 58 formed from a thin walled material. The reflector member 52 is arranged between the third portion 50 and a spacer 53. A fastener 55, such as a rivet for example, secures the spacer 53 to the end 31 of heat sink 28. The spacer 53 includes a projection 57 that assists in maintaining the reflector member 52 centered on the heat sink 28.

In one embodiment, the reflector member 52 has a radius 59 of 0.52 inches with the center of the arc being positioned at a radius 61 of 0.873 inches from the center axis and offset 63 of 0.031 inches from the bottom surface 65. The bottom portion of the curved outer surface has an outer diameter of approximately 0.704 inches and the top portion has an outer diameter of approximately 1.78 inches. In this embodiment, the reflector member 52 is made from a suitable plastic material that may be thermoformed to the desired shape.

The LED modules 42 are arranged at a radius of 0.535 inches on the circuit board 40. In this embodiment, the LED modules 42, the reflective member 52, the first portion 46 and the second portion 48 cooperate to provide the substantially uniform luminous intensity when viewed from the end of luminaire 20.

During operation, the luminaire 20 is coupled to a lighting system, such that the electrical contact 27 is disposed to receive electrical current from an AC mains power supply via a switch or dimmer switch. The electrical current flows through the electrical contact 27 into the driver circuit 34, which adapts the input electrical current to have characteristics desirable for operating the LED modules 42. In an example embodiment, the driver circuit 34 includes circuitry for accommodating a dimmable lighting system. In some conventional lighting systems, a dimmer switch may be used to lower the luminosity of the light bulbs. This is usually accomplished by chopping the AC current or in more elaborate systems by stepping down the voltage. Unlike an incandescent light bulb, which can tolerate (to a degree) sudden and large changes in the electrical voltage, the LED device performance will be less than desirable. In this embodiment, the driver circuit 34 includes circuitry for smoothing out the input electrical voltage and current to allow the LED modules 42 to operate without interruption of electrical power at lower luminosity levels.

Figure 10:
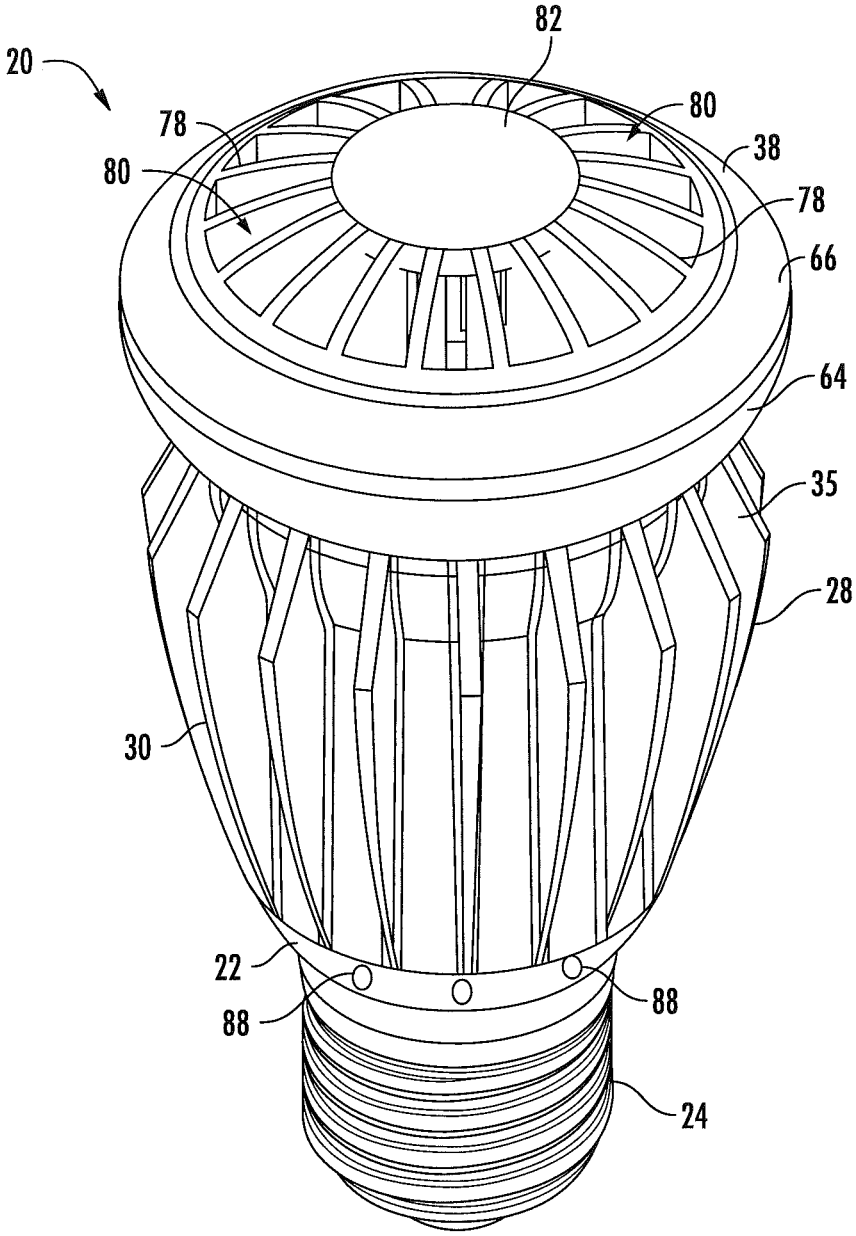
FIG. 10 is a perspective view illustration of another embodiment of the invention.
Figure 11:
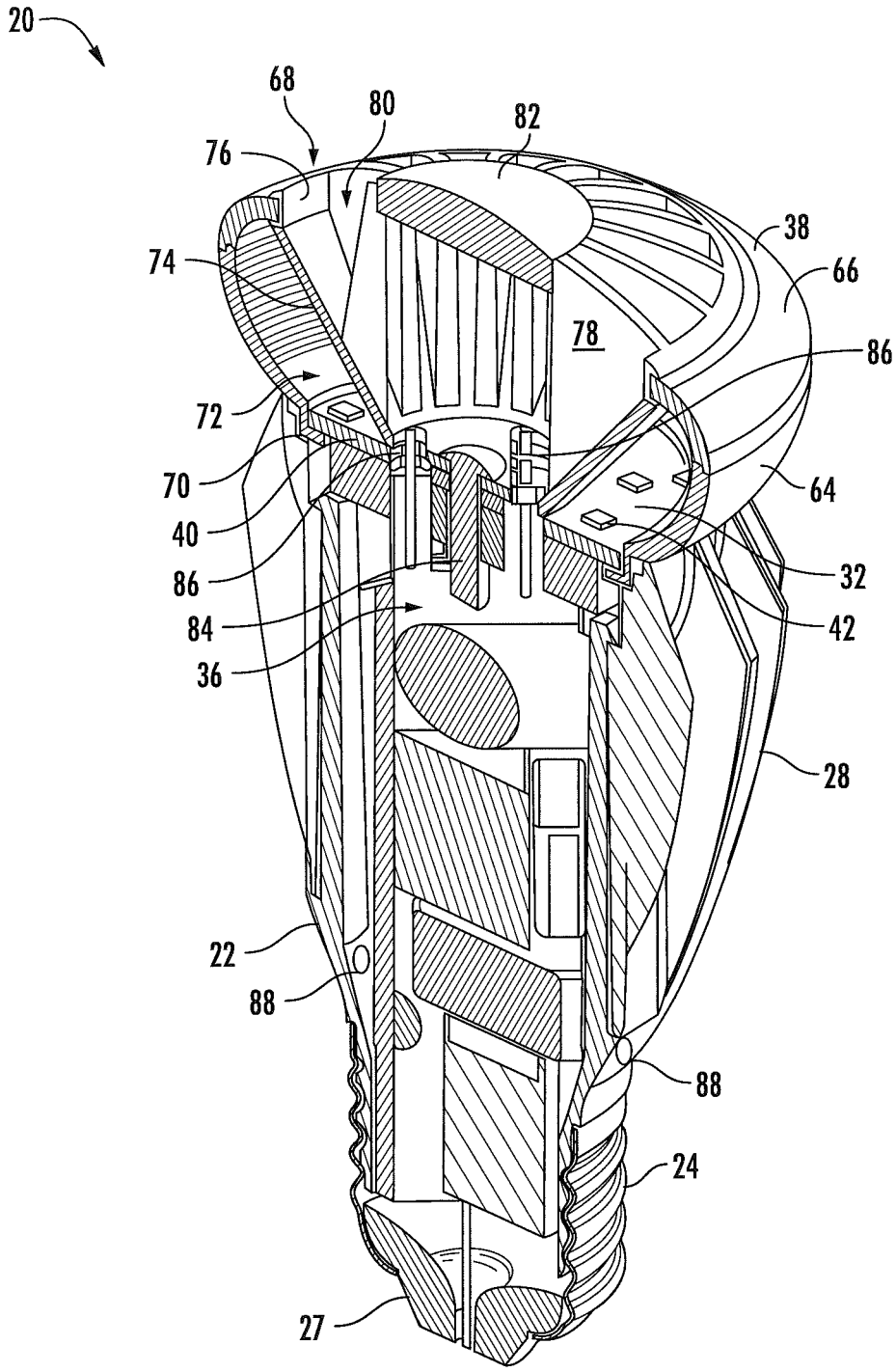
FIG. 11 is a perspective view illustration, partially in section, of the luminaire of FIG. 10.
Figure 12:
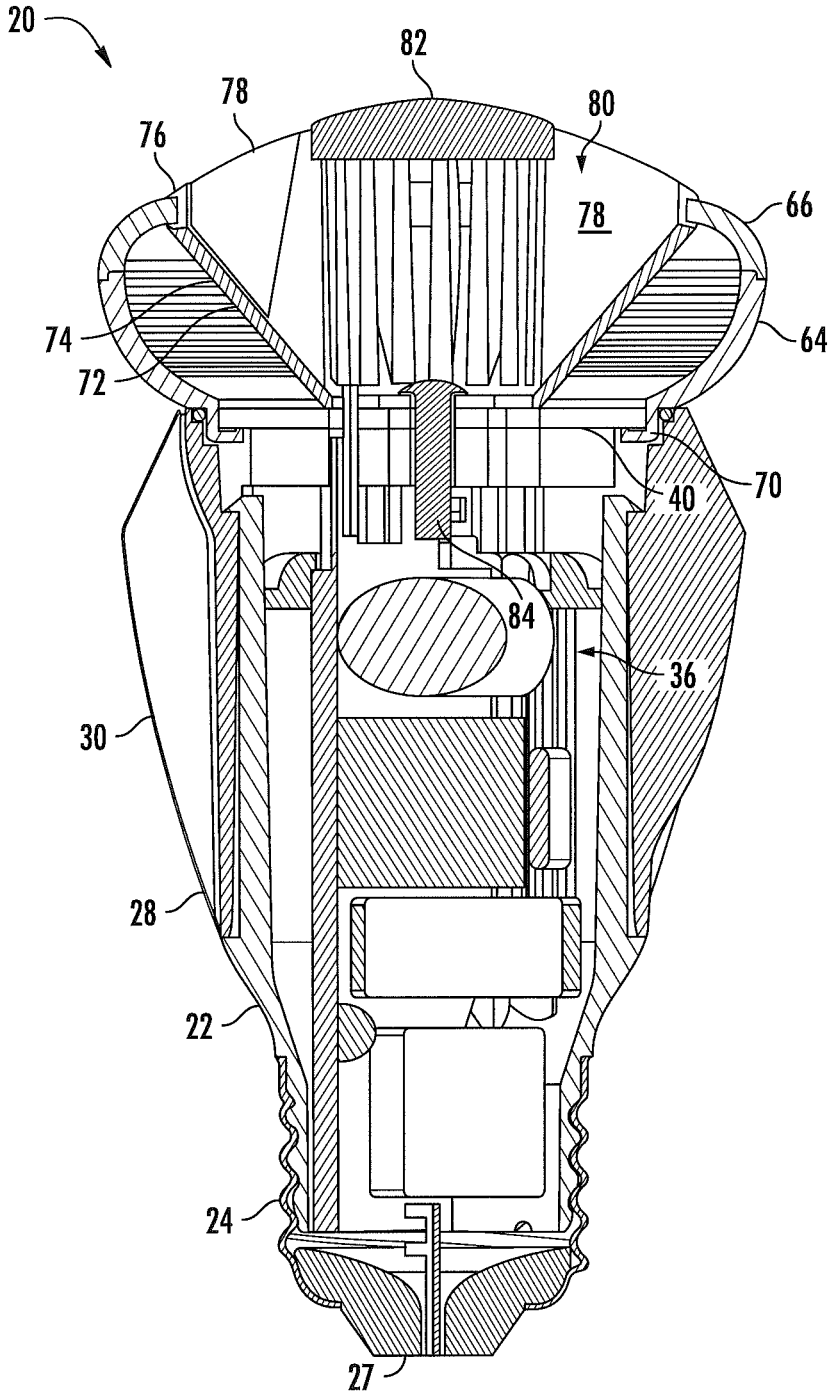
FIG. 12 is a side plan view illustration, partially in section of the luminaire of FIG. 10.

Referring now to FIGS. 10-12 another embodiment of the luminaire 20 is shown. In this embodiment, the lens 38 includes a first portion 64 and a second portion 66. The second portion 66 defines an opening 68 in the lens 38. The first portion 64 includes four tabs 70 that are arranged to receive the circuit board 40 of LED light source 32. It should be appreciated that the tabs 70 couple the lens 38 to the heat sink 28 when the circuit board 40 is secured as will be discussed in more detail below.

Disposed within the opening 68 is a reflective member 72. The reflective member 72 includes a frustoconical or toroidal wall 74 that extends from the circuit board 40 to the edge of second portion 66. The wall 74 reflects light emitted by the LED modules 42 and cooperates with the first portion 64 and second portion 66 to distribute light with an even luminous intensity as discussed herein above with respect to reflector member 52. The wall 74 terminates at a rim 76 that engages the inner diameter of second portion 66. Disposed within the inner portion of the reflective member 72 is a plurality of rib members 78. The rib members 78 are arranged along one edge to the inner surface of wall 74, a second edge couples to the rim 76. The rib members 78 extend in a radial direction inward to define a plurality of openings 80 therebetween. The rib members are coupled along an inner radius to a top portion 82.

Opposite the top portion 82, a fastener 84 couples the reflective member 72 and the circuit board 40 to the heat sink 28. In the exemplary embodiment, the fastener 84 is axially disposed within the luminaire 20. A plurality of openings 86 is disposed about the fastener 84. The openings 86 extend through the reflective member 72, the circuit board 40 and the heat sink 28 to allow air to flow into the interior portion 36. In one embodiment, the openings 80, 86 cooperate with additional openings 88 in the intermediate member 22 to allow the flow of air through the interior portion 36. It should be appreciated that the flow of air will remove thermal energy generated by the LED modules 42 during operation. This provides advantages in maintaining the LED modules 42 at a cooler operating temperature, which increases the useful operating life of the luminaire. In another embodiment, the openings 88 are arranged in the heat sink 28. In yet another embodiment, the luminaire 20 may include heat pipes (not shown) disposed in or adjacent to the openings 88 to further facilitate the removal of thermal energy from the interior of the luminaire 20.

Figure 13:
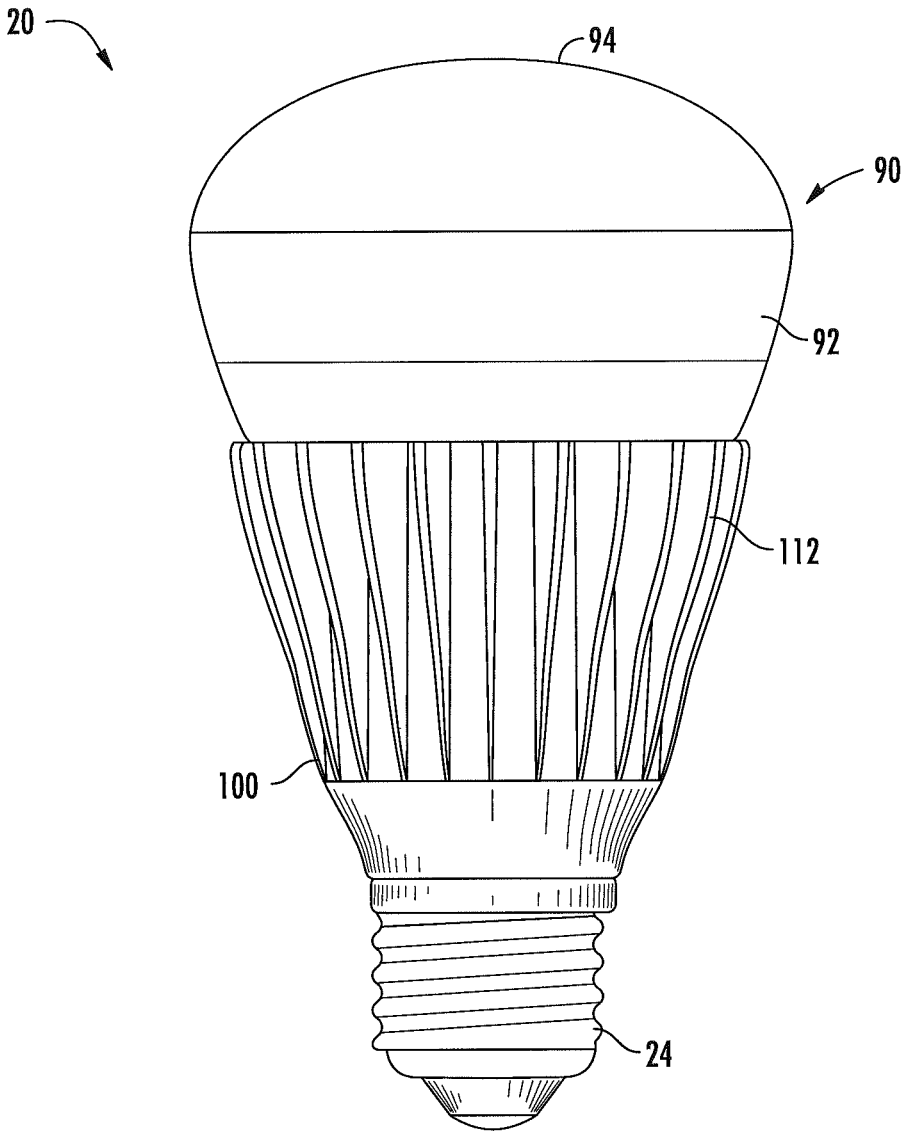
FIG. 13 is a side view illustration of a luminaire in accordance with another embodiment of the invention.
Figure 14:
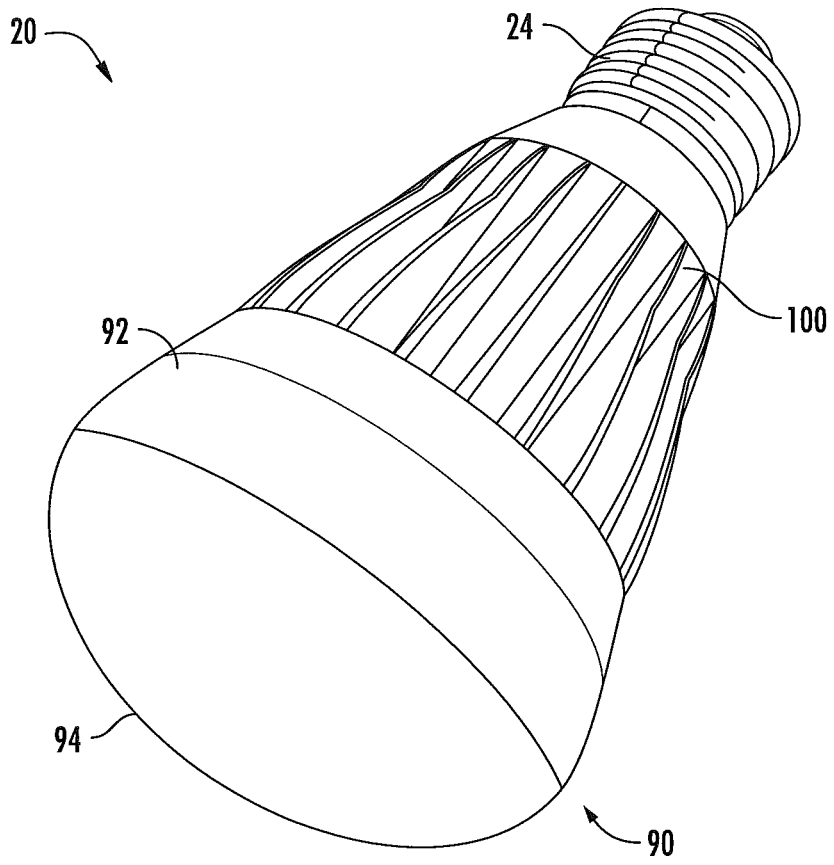
FIG. 14 is a perspective view illustration of the luminaire of FIG. 13.
Figure 15:
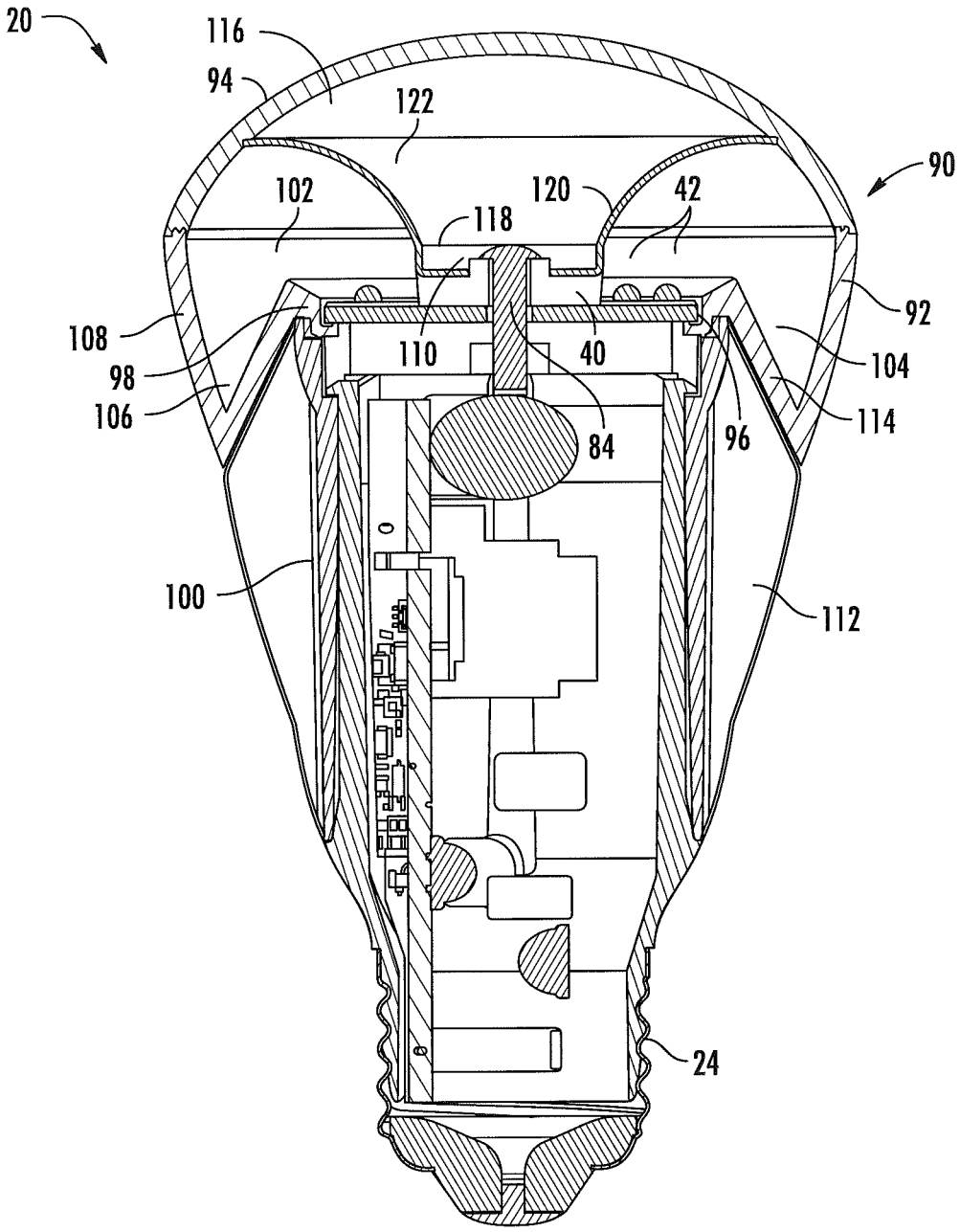
FIG. 15 is a sectional view illustration of the luminaire of FIG. 13.
Figure 16:
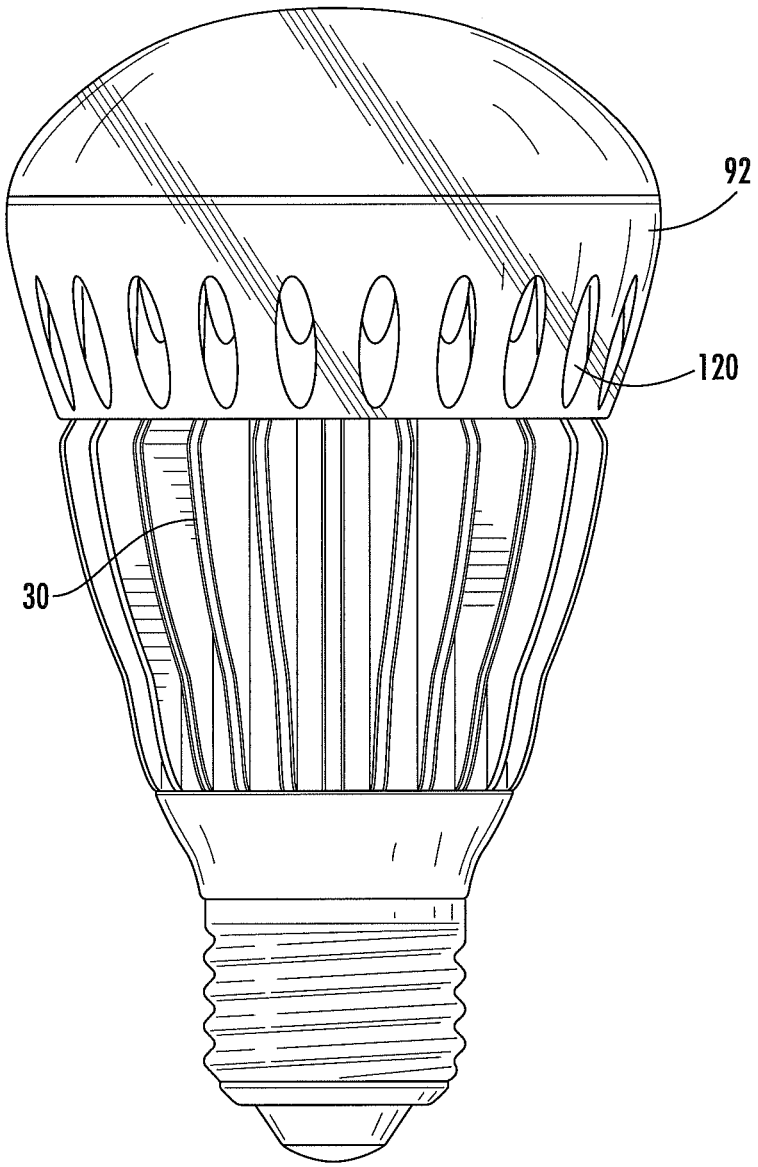
FIG. 16 is a side view illustration of a luminaire in accordance with another embodiment of the invention.
Figure 17:
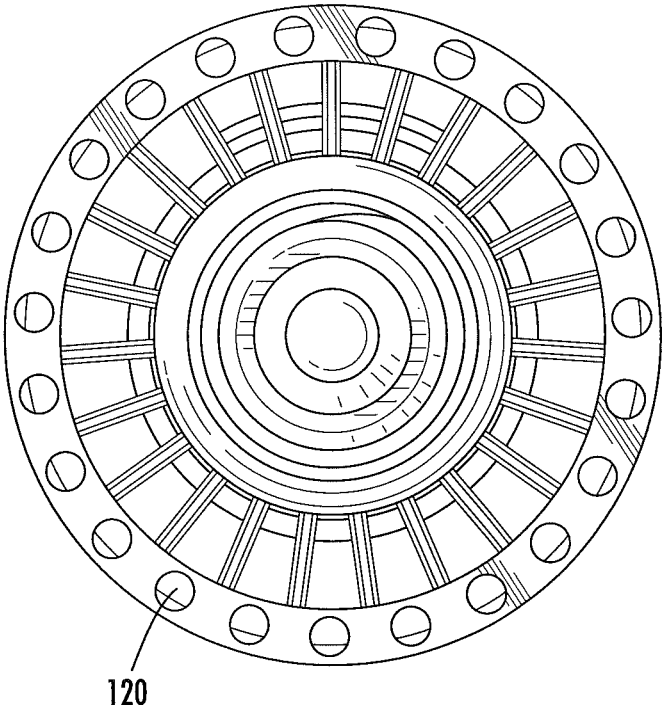
FIG. 17 is a bottom view illustration of the luminaire of FIG. 16.
Figure 18:
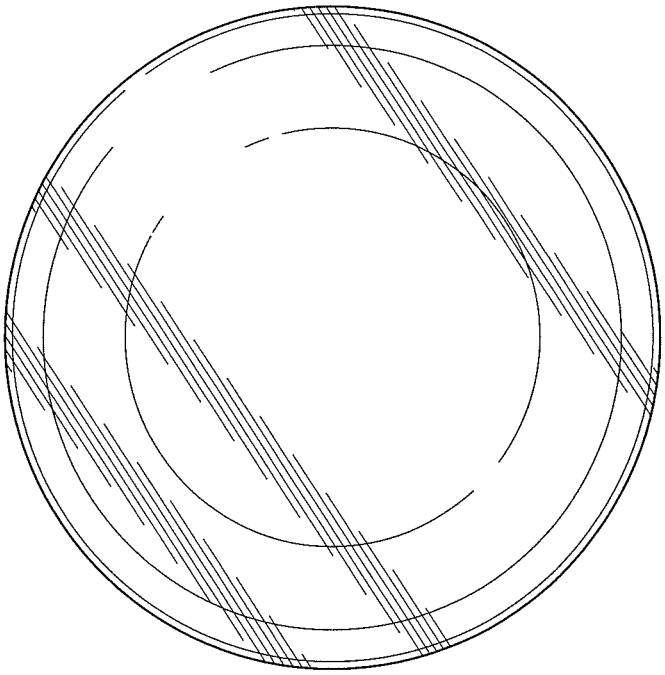
FIG. 18 is a top view illustration of the luminaire of FIG. 16.
Figure 19:
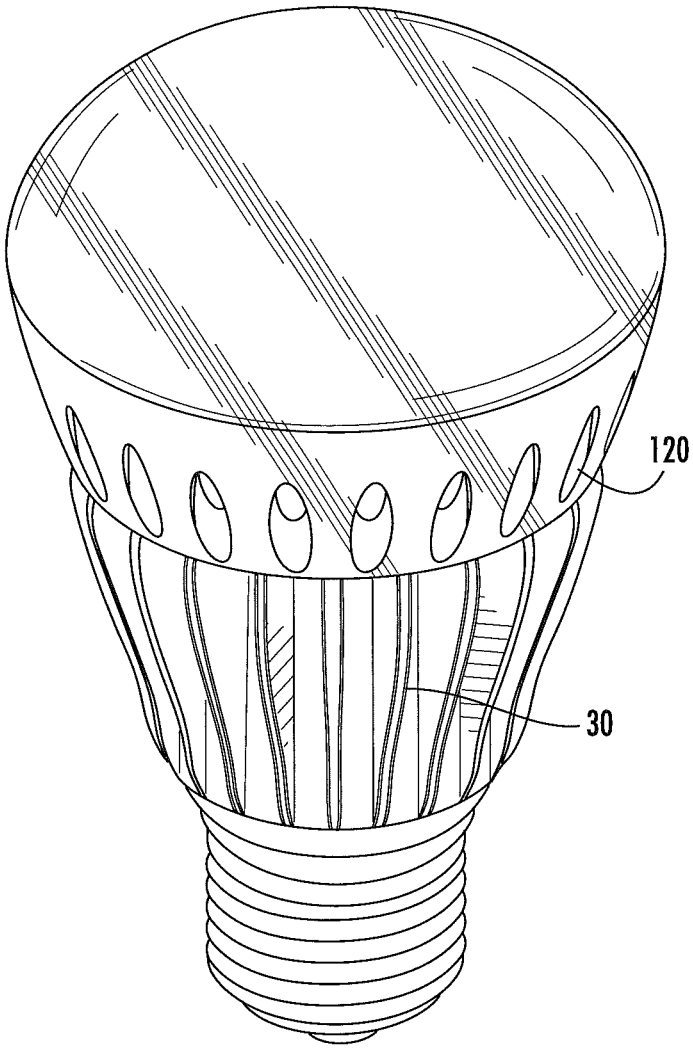
FIG. 19 is a first perspective view illustration of the luminaire of FIG. 16.
Figure 20:
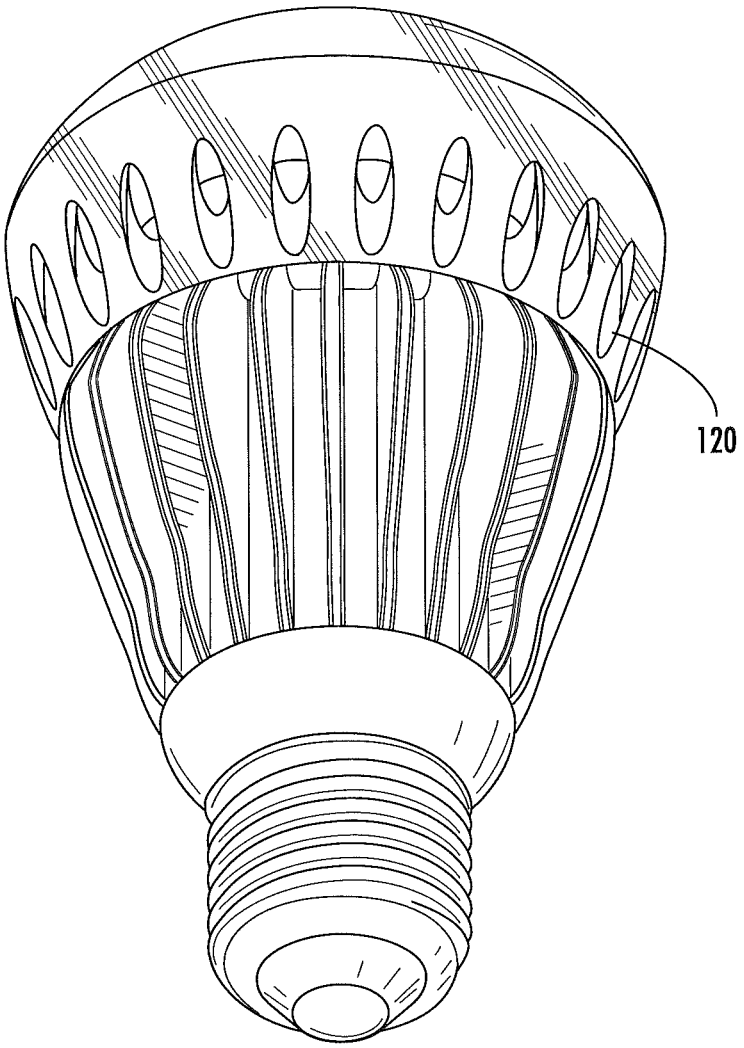
FIG. 20 is a second perspective view illustration of the luminaire of FIG. 16.
Figure 21:
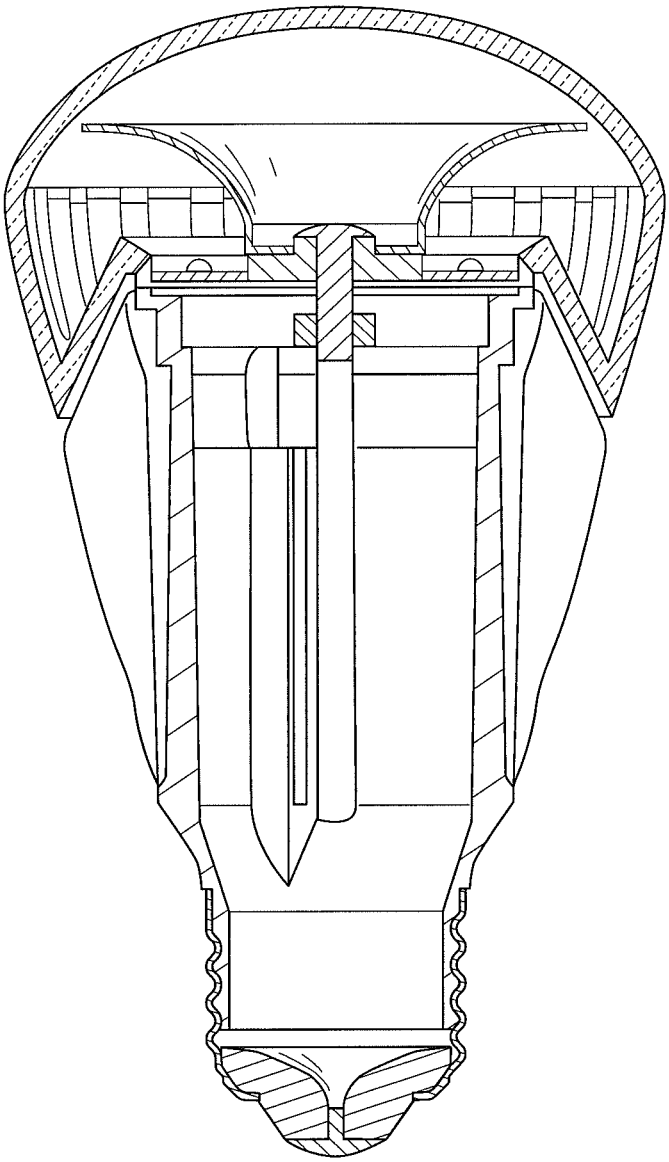
FIG. 21 is a side sectional view illustration of the luminaire of FIG. 16.
Figure 22:
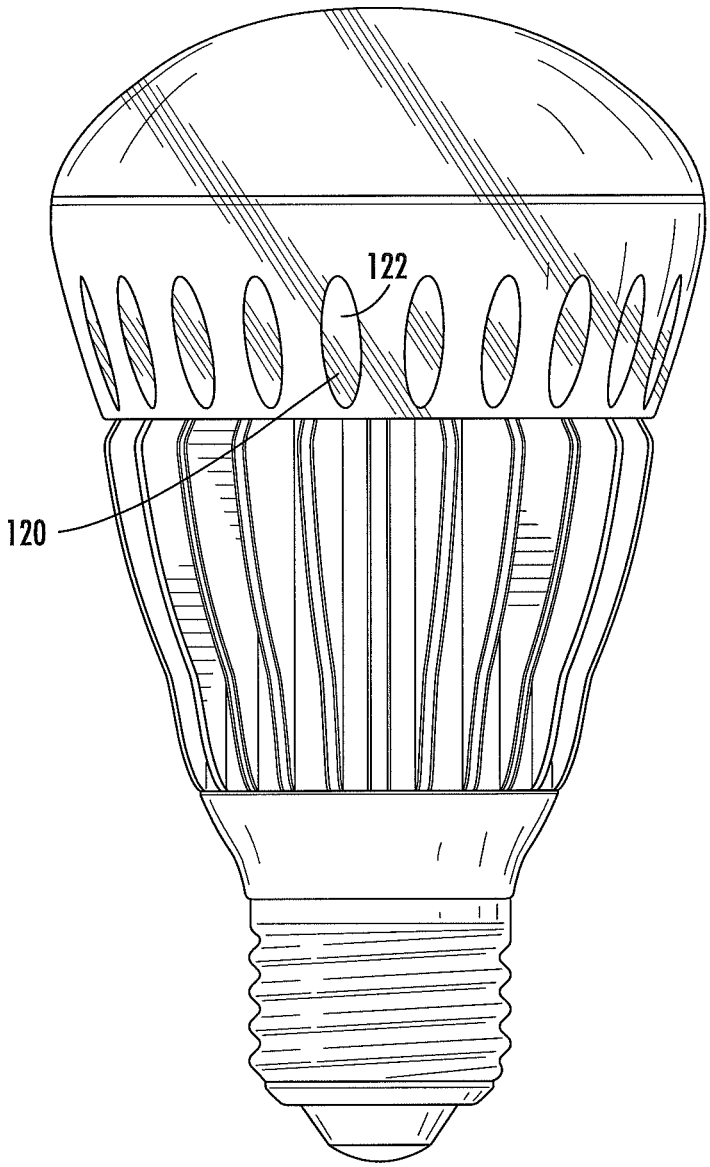
FIG. 22 is a side view illustration of a luminaire in accordance with another embodiment of the invention.
Figure 23:
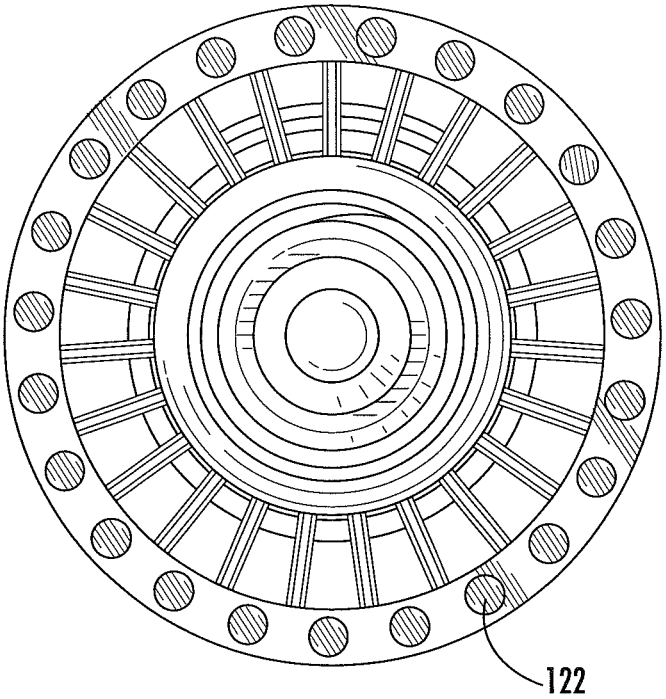
FIG. 23 is a bottom view illustration of the luminaire of FIG. 22.
Figure 24:
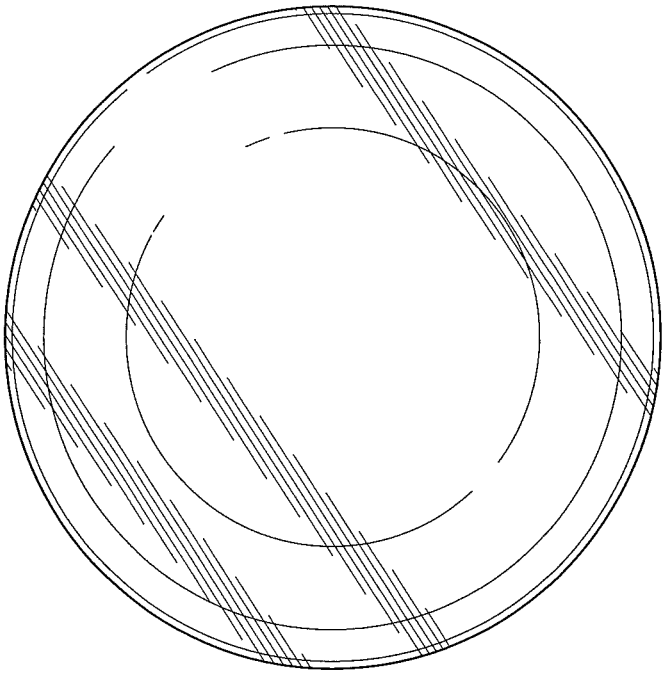
FIG. 24 is a top view illustration of the luminaire of FIG. 22.
Figure 25:
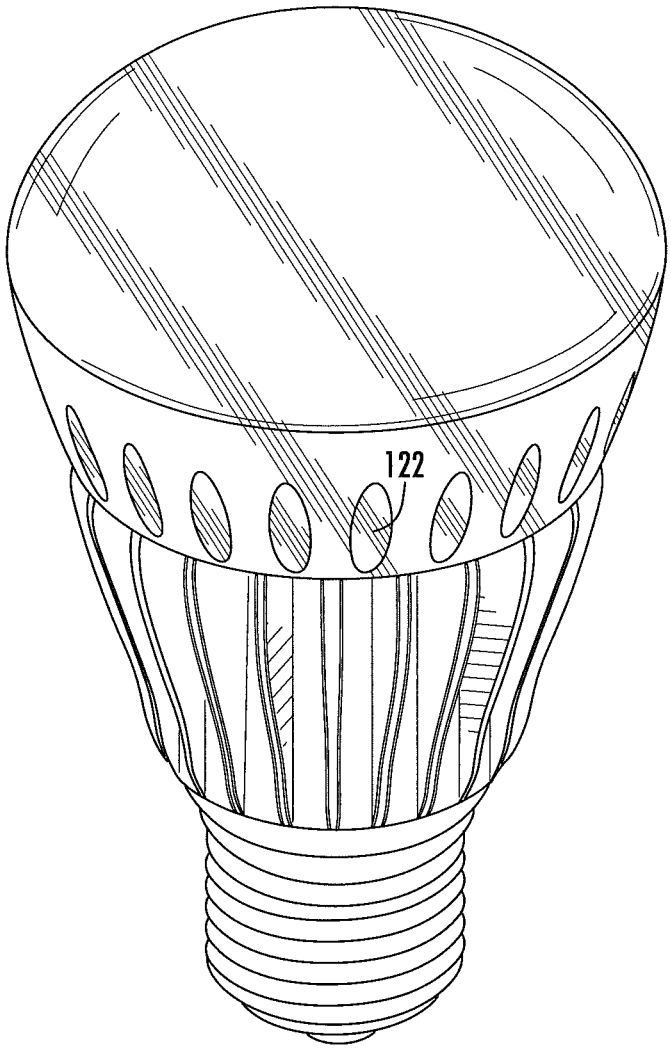
FIG. 25 is a first perspective view illustration of the luminaire of FIG. 22.
Figure 26:
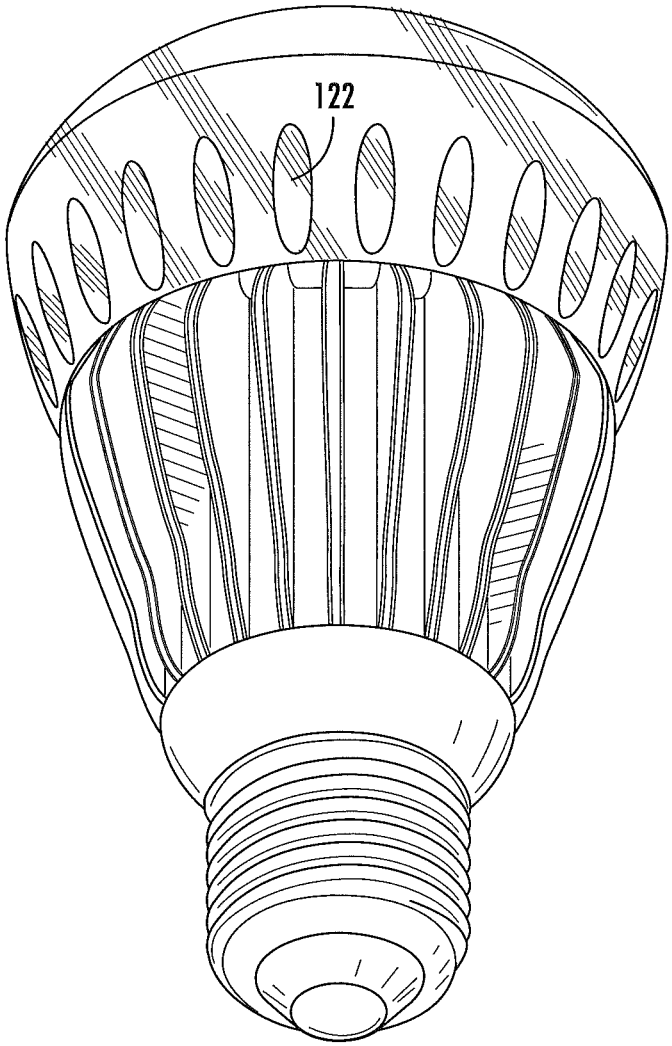
FIG. 26 is a second perspective view illustration of the luminaire of FIG. 22.
Figure 27:
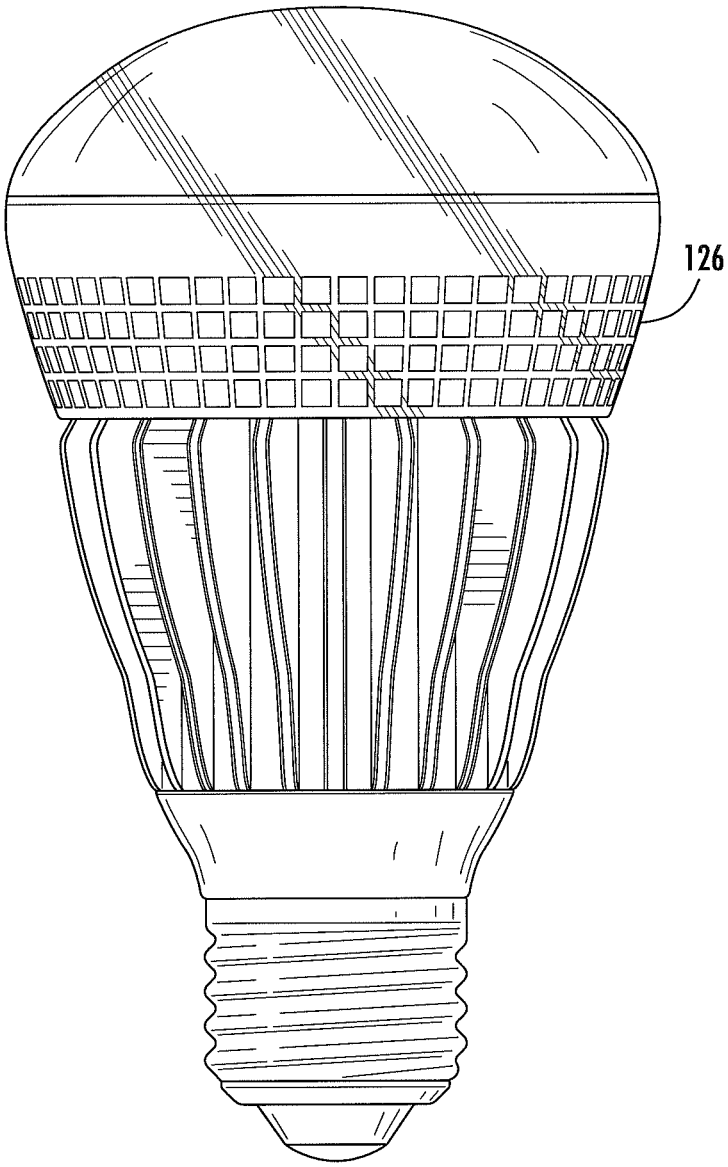
FIG. 27 is a side view illustration of a luminaire in accordance with another embodiment of the invention.
Figure 28:
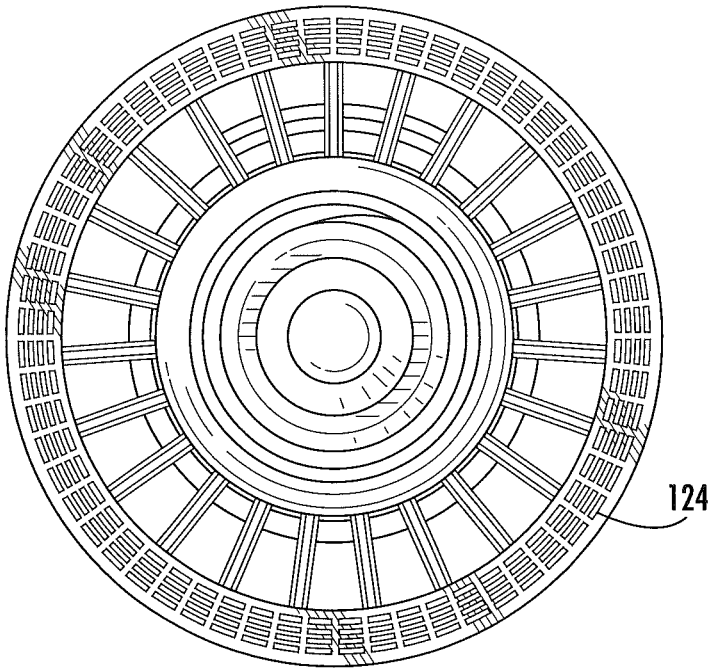
FIG. 28 is a bottom view illustration of the luminaire of FIG. 27.
Figure 29:
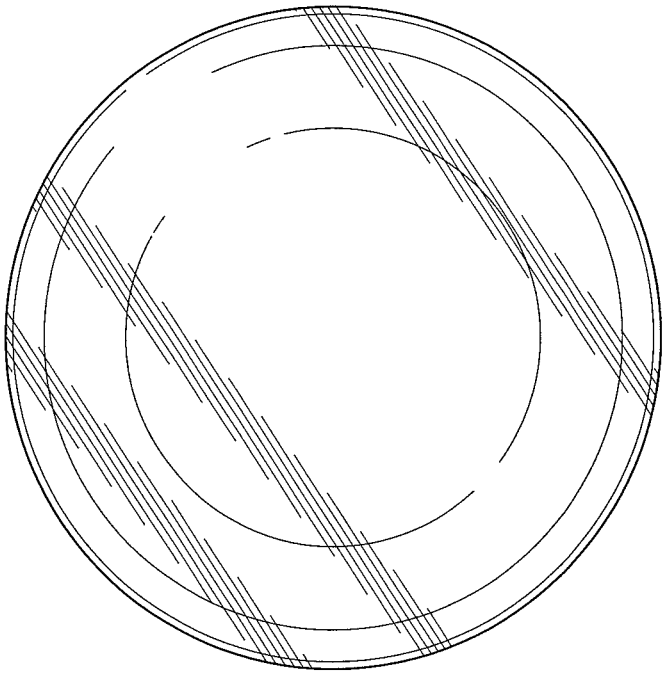
FIG. 29 is a top view illustration of the luminaire of FIG. 27.
Figure 30:
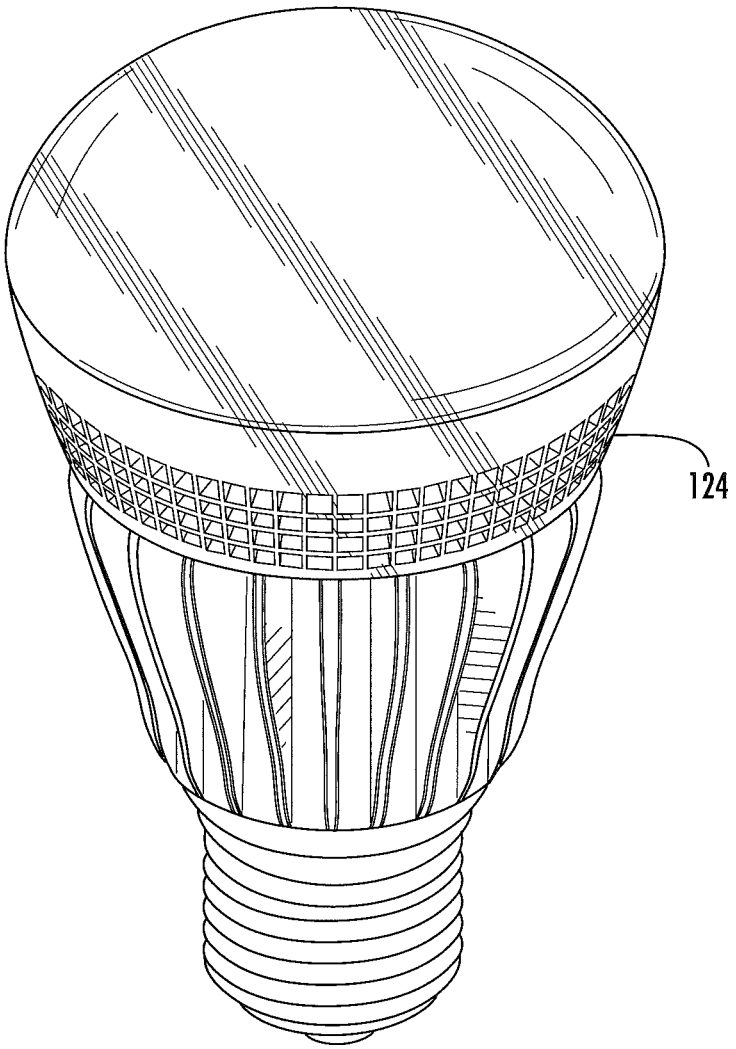
FIG. 30 is a first perspective view illustration of the luminaire of FIG. 27.
Figure 31:
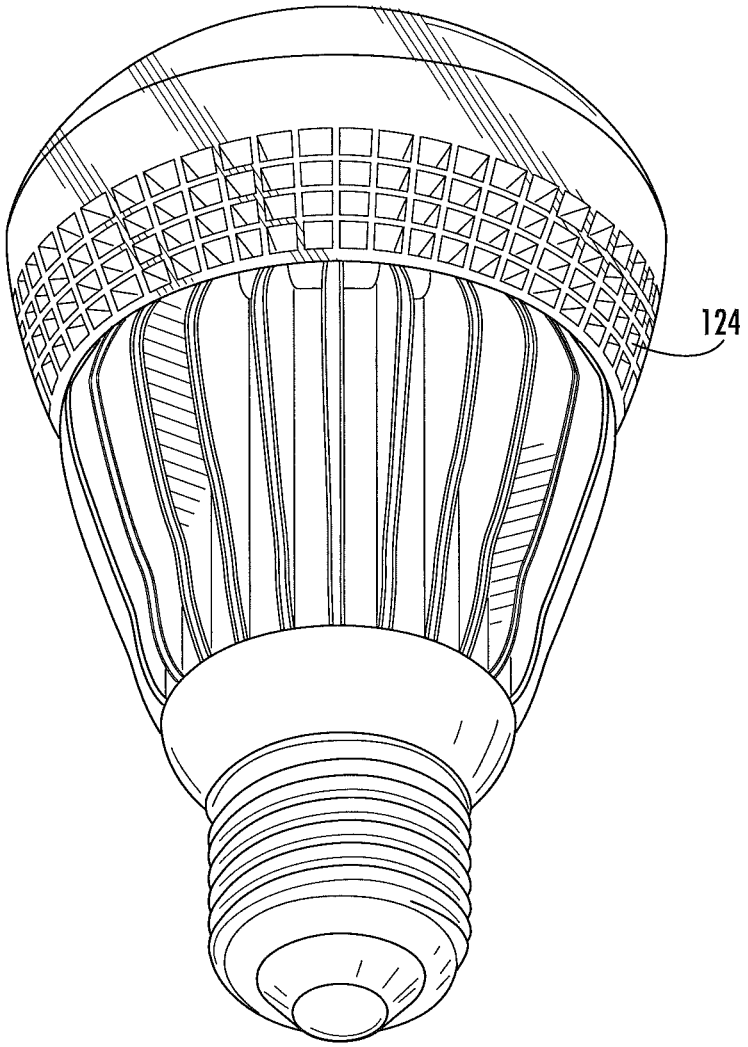
FIG. 31 is a second perspective view illustration of the luminaire of FIG. 27.
Figure 32:
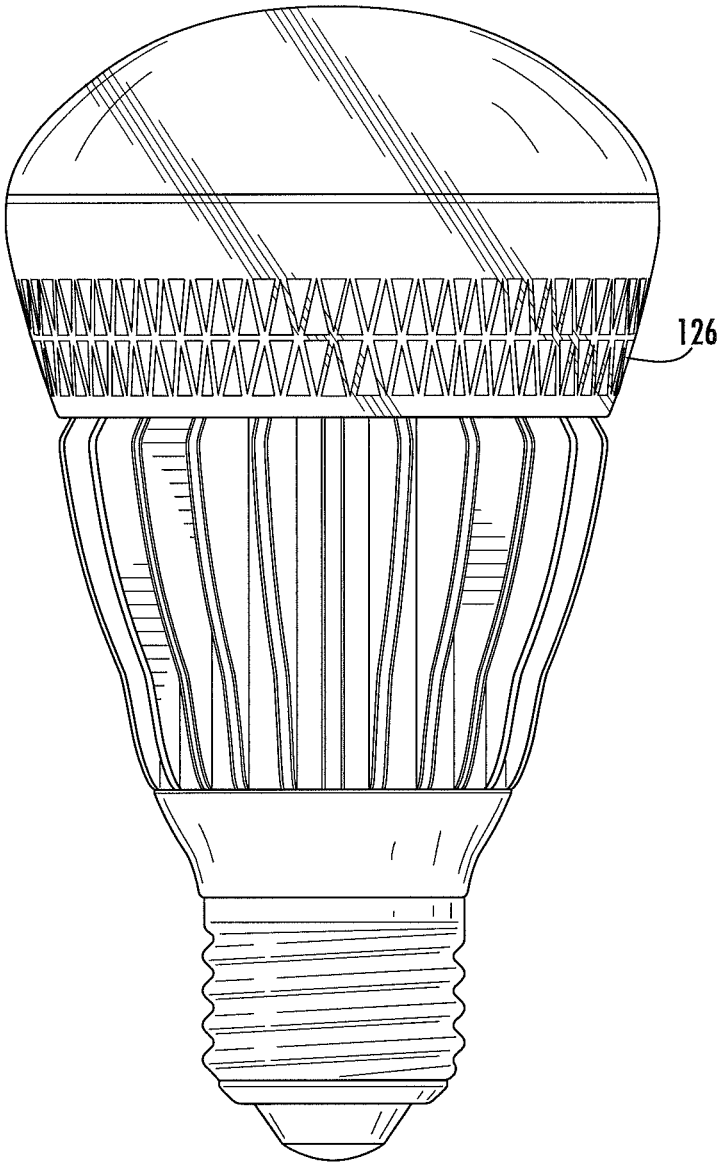
FIG. 32 is a side view illustration of a luminaire in accordance with another embodiment of the invention.
Figure 33:
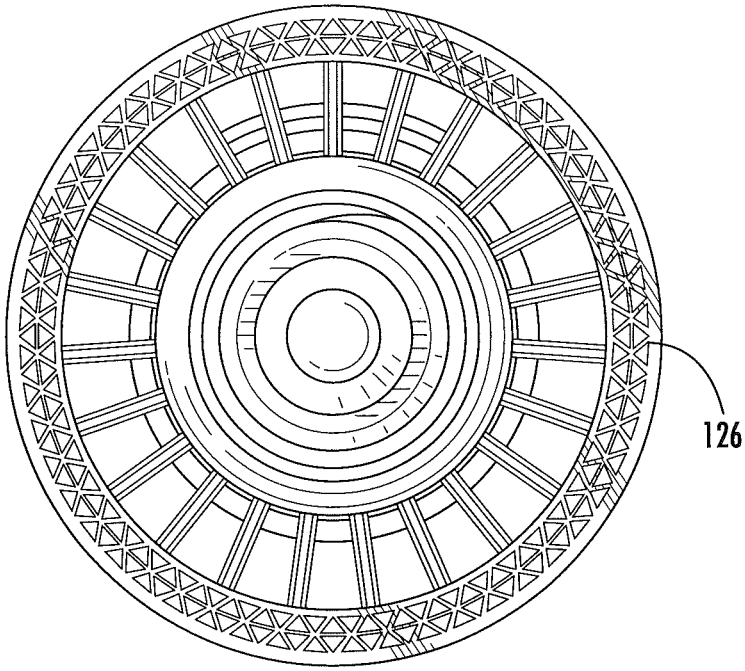
FIG. 33 is a bottom view illustration of the luminaire of FIG. 32.
Figure 34:
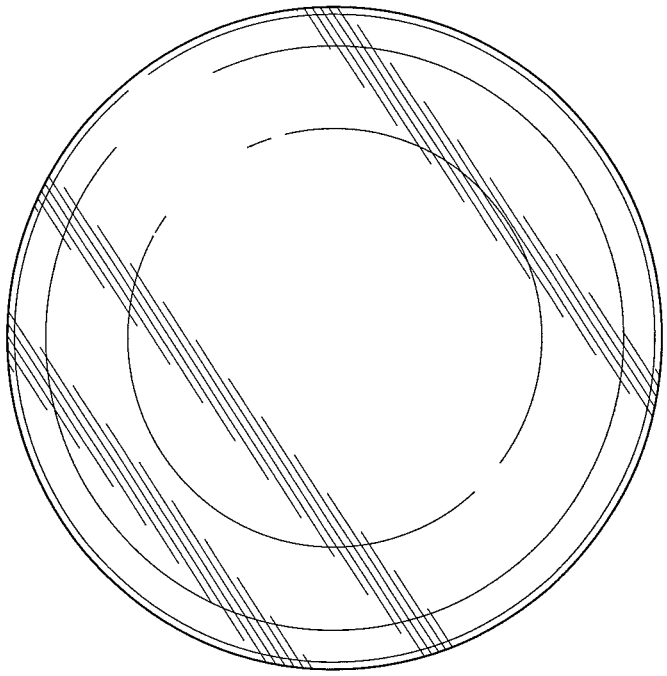
FIG. 34 is a top view illustration of the luminaire of FIG. 32.
Figure 35:
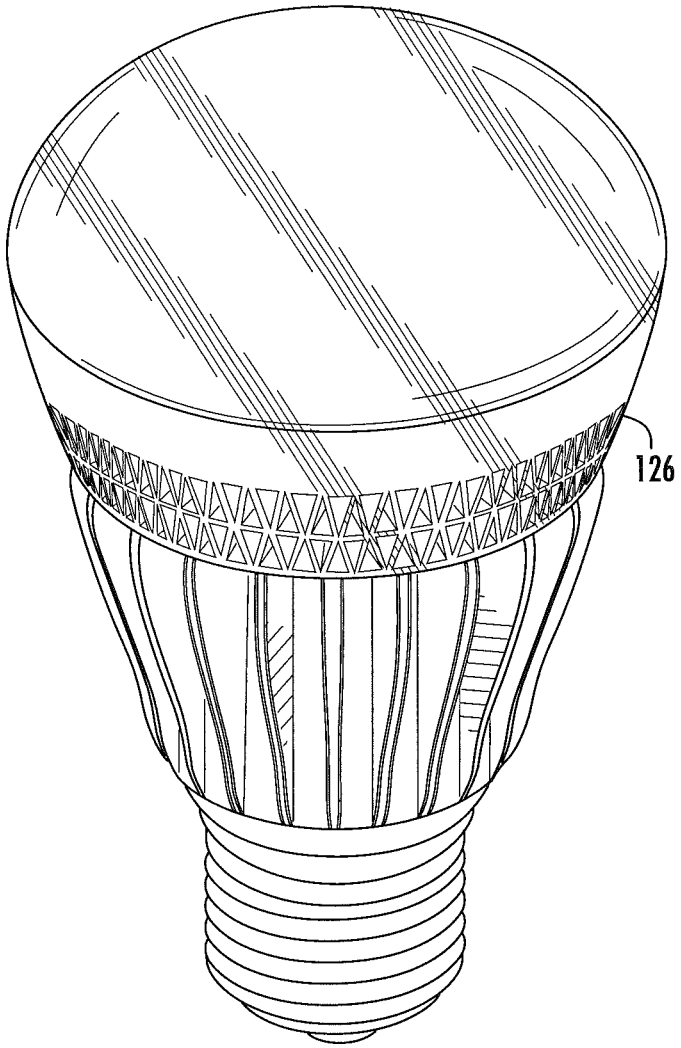
FIG. 35 is a first perspective view illustration of the luminaire of FIG. 32.
Figure 36:
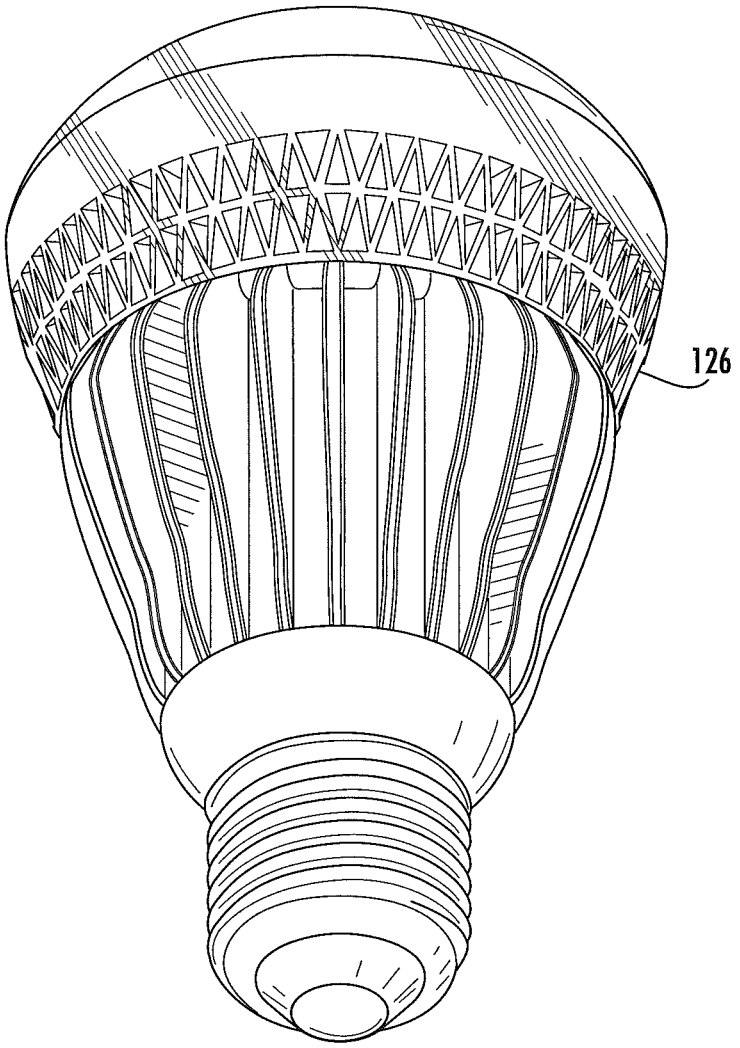
FIG. 36 is a second perspective view illustration of the luminaire of FIG. 32.
Figure 37:
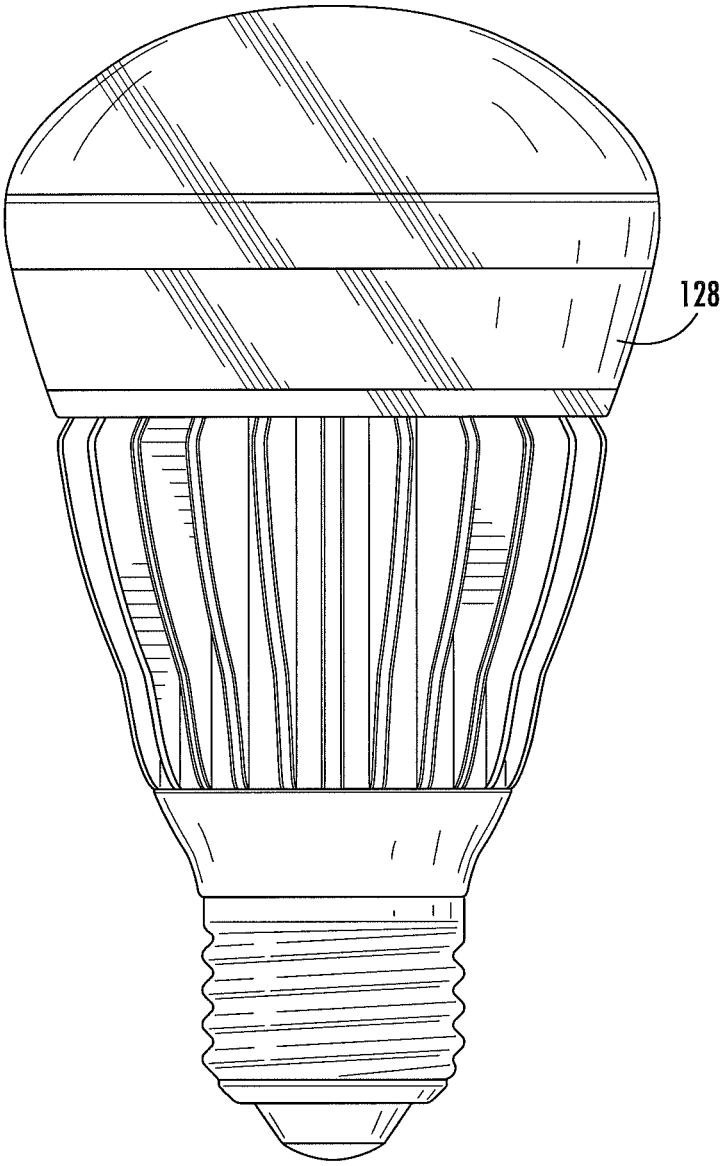
FIG. 37 is a side view illustration of a luminaire in accordance with another embodiment of the invention.
Figure 38:
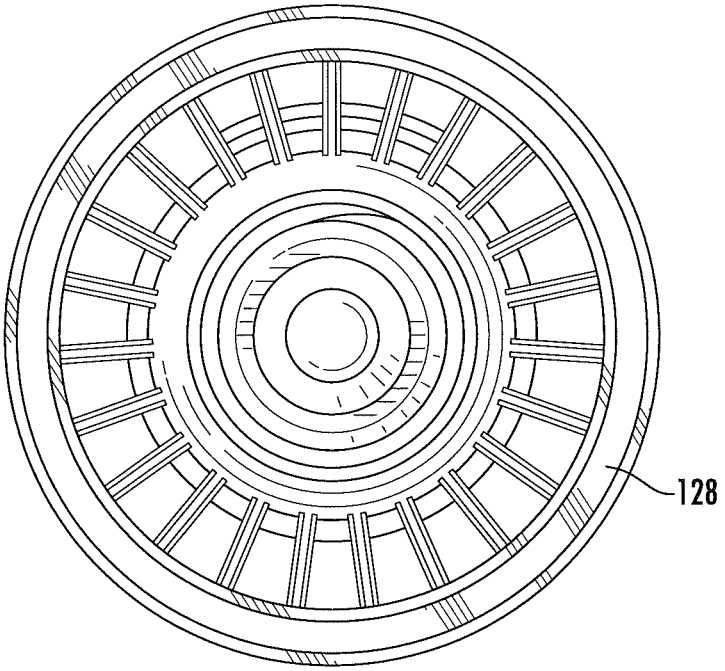
FIG. 38 is a bottom view illustration of the luminaire of FIG. 37.
Figure 39:
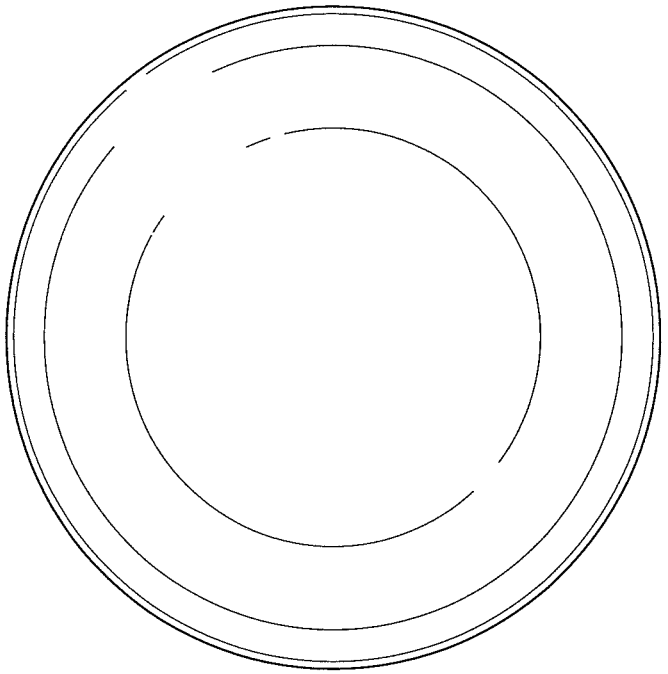
FIG. 39 is a top view illustration of the luminaire of FIG. 37.
Figure 40:
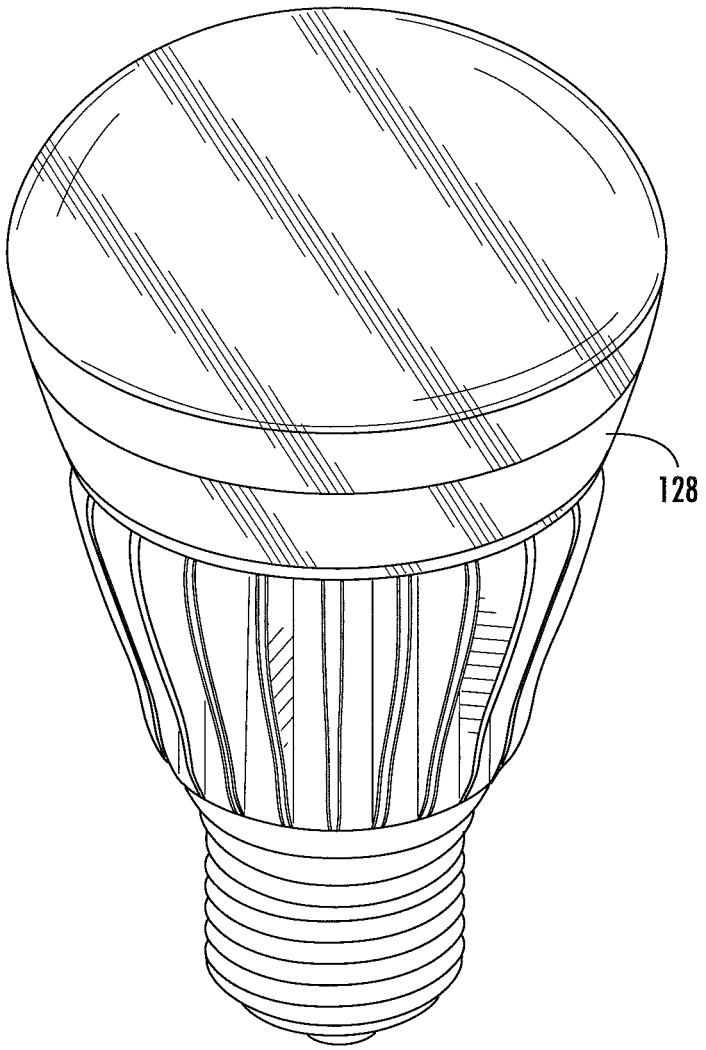
FIG. 40 is a first perspective view illustration of the luminaire of FIG. 37.
Figure 41:
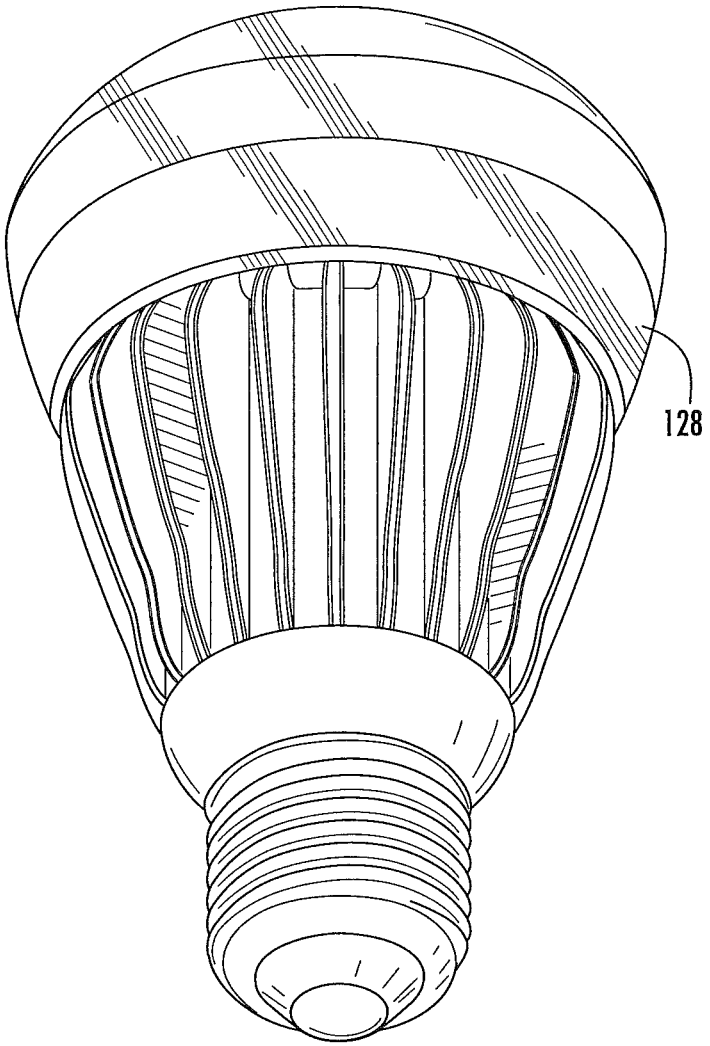
FIG. 41 is a second perspective view illustration of the luminaire of FIG. 37.

Referring now to FIGS. 13-37, another series of embodiments of the luminaire 20 are shown. In these embodiments, the luminaire 20 includes a lens 90 having a first portion 92 and a second portion 94 (this is best shown in FIGS. 13-15). The first portion 92 includes a lip 96 that is captured within a recess 98 in the heat sink 100 by the circuit board 40. The first portion 92 includes a first conical surface 102 that is positioned adjacent the LED modules 42. A second conical surface 104 extends outward in a direction away from the second portion 94. In one embodiment, the second conical surface 104 is arranged such that an end 106 of the second conical surface 104 is positioned below (as viewed from FIG. 14) the circuit board 40. Finally, the first portion 92 includes a curved surface 108 that defines the outer periphery of the first portion 92. It should be appreciated that the configuration of the second conical surface 104 allows the reflected light to be directed in the 135°-180° zone. In one embodiment, the heat sink 100 has a plurality of ribs 112. Each rib 112 has a surface 114 adjacent and angled to substantially conform to the second conical surface 104.

The second portion 94 of the lens 90 has a curved or semi-spherical shape. The luminaire 20 further includes a curved reflector member 116 disposed between the second portion 94 and a spacer 110. The fastener 84, such as a rivet for example, couples the spacer 110 and the circuit board 40 to the heat sink 100. The spacer 110 further spaces the bottom surface 118 of the reflector member 116 apart from the circuit board 40. In one embodiment, the reflector member 116 has a cylindrical portion 120 extending from the bottom surface 118. A toroidal or curved surface 122 extends between the cylindrical portion 120 and the second portion 94.

As discussed above, the LED members 41 emit light that is reflected off the outer surface of the reflector member 52 towards the first portion 92 and the second portion 94 of the lens 90. The reflection of the light by the reflector member 52 and the diffusion of the light by the lens 90 results in the distribution light with an even luminous intensity as discussed above.

Referring more specifically now to the embodiment shown in FIGS. 16-21, it should be appreciated that the first portion 92 (i.e. the diffusing optic) may be inclusive of a plurality of apertures or openings 120 disposed therein of therethrough. In an exemplary embodiment such as that shown in FIGS. 16-21, these apertures 120 may be open through an entire thickness of the first portion 92, and be disposed between the ribs 30 (if the ribs were to be extended relatively upwards). In addition, the apertures 120 may be of varying shapes such as but limited to circular, elliptical, oval, square, rectangular, diamond, and polygonal. Though the apertures are shown in FIGS. 16-21 to include uniform size, area, spacing, and width across an entire depth of each (i.e. across an entire thickness of first portion 92), it should be appreciated that the apertures 120 may also vary with regards to size, area, and shape, and include a tapering in width through the first portion 92 in at least one of the apertures 120.

Referring specifically now to the embodiment shown in FIGS. 22-26, it should be appreciated that the apertures 120 may include a covering surface 122. In this embodiment, the surface 122 is a transmissive material with optical properties different from the surrounding first portion 92. These different optical properties may be achieved via a co-molded or overlaid surface 122 that includes a different thickness, gradient, material, or polycarbonate than the surrounding first portion 92.

Referring specifically now to the embodiment shown in FIGS. 27-36, it should be appreciated that the apertures 120 may also be micro-apertures disposed circumferentially about the first portion 92. In FIGS. 27-31 these micro-apertures 120 are shown to be disposed in a "net-like" pattern 124, and in FIGS. 32-36 these micro-apertures 120 are shown to be disposed in a "web-like" pattern 126. It should be appreciated that both the net like micro-apertures and web-like micro-apertures may include a covering surface 122 such as that discussed with reference to FIGS. 22-26. The micro-apertures may also be coated with a super-hydrophobic material to render impermeable.

Referring specifically now to the embodiment shown in FIGS. 37-41, it should be appreciated that the apertures 120 may be a single continuous band or window 128. In such an embodiment, the band 128 be covered with a transmissive material (such as cover 122) with optical properties different from the surrounding first portion 92, wherein these different optical properties may be achieved via a co-molded or overlaid surface that includes a different thickness, gradient, material, or polycarbonate than the surrounding first portion 92. In addition, the band 128 may comprise a single material or multiple materials, and be of varying thickness so as to optimize transmissivity and a desired distribution of luminous energy.

From the foregoing, it will be appreciated that the Edison base 24, optic 54 and heat sink 28 of luminaire 20, collectively may have a profile so configured and dimensioned as to be interchangeable with a standard A19 lamp, and the driver circuit 35 and the LED light source 36 may be so configured and dimensioned as to be disposed within the A19 profile.

As disclosed, some embodiments of the invention may include some of the following advantages: a LED luminaire usable as a direct replacement for incandescent lamps in existing lighting systems; a LED luminaire having lower energy usage, increased heat diffusion, and/or increased luminosity with respect to an incandescent lamp having a similar wattage rating or with respect to a prior art LED luminaire having a similar operational power rating; a LED luminaire that transmits light in a direction towards the base 24, and, an LED luminaire that creates a light output distribution similar to an incandescent.

The particular and innovative arrangement of components according to the invention therefore affords numerous not insignificant technical advantages in addition to an entirely novel and attractive visual appearance.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A luminaire, comprising:

an electrical base;

a driver circuit in electrical communication with the electrical base;

a heat sink operably coupled to the electrical base;

a lens coupled to the heat sink, the lens having a first portion adjacent the heat sink and a second portion adjacent the first portion, the first portion having at least one aperture disposed therein or therethrough, the at least one aperture having a different optical transmission property from the first portion in which the at least one aperture is disposed;

a reflective member disposed between the second portion and the heat sink; and, a light emitting diode (LED) light source disposed between the reflective member and the heat sink, the LED light source having at least one LED member arranged between the reflective member and the first portion to emit at least a portion of light towards the reflective member, each LED member being disposed in electrical communication with the driver circuit.

2. The luminaire of claim 1 wherein:

the reflective member is a frustoconical or toroidal shape with a reflective outer surface; and, at least the reflective outer surface, the first portion, and the at least one aperture cooperate to distribute light emitted from the LED light source with a substantially even luminous intensity around a perimeter of the lens.

3. The luminaire of claim 1, wherein the at least one aperture has a higher optical transmissivity parameter than the first portion.

4. The luminaire of claim 1, wherein the at least one aperture includes a plurality of apertures disposed circumferentially about the first portion.

5. The luminaire of claim 4, wherein the heat sink includes a plurality of ribs disposed circumferentially about the heat sink and the plurality of apertures are disposed to direct light between the plurality of ribs.

6. The luminaire of claim 4, wherein the plurality of apertures are formed in a shape selected from a group comprising: circular, elliptical, oval, square, rectangular, parallelogram, triangular, diamond, and polygonal.

7. The luminaire of claim 6, wherein the apertures include at least one of uniform sizes, uniform areas, uniform spacing, and a uniform width across an entire depth of each.

8. The luminaire of claim 6, wherein the apertures vary in at least one of size, area, and spacing, and at least one of the apertures includes a tapering across a depth thereof.

9. The luminaire of claim 1, wherein the at least one aperture is in the shape of a ring disposed circumferentially about the first portion.

10. The luminaire of claim 1, wherein the light is distributed with a substantially even luminous intensity in a 0° to 135° zone relative to a longitudinal axis of the luminaire.

11. The luminaire of claim 1, wherein the at least one aperture is a plurality of micro-apertures disposed in a net-like pattern.

12. The luminaire of claim 1, wherein the at least one aperture is a plurality of micro-apertures disposed in a web-like pattern.

13. A luminaire comprising:

an electrical base;

a heat sink having a plurality of ribs coupled to the electrical base;

a lens coupled to the heat sink, the lens having a first portion adjacent the heat sink and a second portion adjacent the first portion opposite the heat sink, the first portion having a plurality of apertures disposed circumferentially about the first portion, wherein each of the plurality of apertures is disposed to direct light substantially between each of the ribs in the plurality of ribs;

a frustoconical or toroidal member having a first end adjacent the heat sink and a second end adjacent the second curved portion; and, a light emitting diode (LED) light source disposed adjacent the first end and the heat sink, the LED light source having at least one LED member arranged between the first end and the first portion and arranged to emit at least a portion of light towards the frustoconical member.

14. The luminaire of claim 13, wherein the plurality of apertures includes a material having a different optical characteristic than the first portion.

15. The luminaire of claim 13, wherein the material has a higher optical transmissivity parameter than the first portion in which the at least one aperture is disposed.

16. The luminaire of claim 15, wherein the light is distributed through the first portion and the plurality of apertures with substantially luminous intensity in a 0° to 135° zone about the luminaire.

17. The luminaire of claim 16, wherein the luminous intensity varies less than 20%.

18. The luminaire of claim 17 wherein at least 5% of total flux is emitted in the 135° to 180° zone.

19. A luminaire comprising:

a heat sink having a plurality of ribs disposed about a circumference;

an LED light source disposed on one end of the heat sink, the LED light source having a plurality of LED modules disposed on a radius about a longitudinal axis of the heat sink;

a lens coupled to the heat sink, the lens having a first portion and a second portion adjacent the first portion, the first portion having at least one aperture, the at least one aperture having a higher optical transmissivity than the first portion; and, a member disposed between the lens and the LED light source, wherein the member has a reflective outer surface disposed between the plurality of LED modules and the lens, wherein at least the reflective outer surface, the first curved portion, and the at least one aperture cooperate to distribute light emitted from the LED light source with a substantially even luminous intensity around a perimeter of the lens.

20. The luminaire of claim 19 wherein at least the plurality of LED modules, the reflective outer surface, the first curved portion, and the at least one aperture cooperate to distribute greater than or equal to 5% of a luminous flux in a 135°-180° first zone relative to the longitudinal axis of the luminaire.

21. The luminaire of claim 19, wherein the light is distributed with substantially uniform luminous intensity in a 0° to 135° zone relative to the longitudinal axis of the luminaire.

22. The luminaire of claim 19, wherein the at least one aperture is in the shape of a band disposed circumferentially about the first surface.

23. The luminaire of claim 19, wherein the at least one aperture includes the plurality of apertures formed in a shape selected from a group comprising: circular, elliptical, oval, square, rectangular, parallelogram, triangular, diamond, and polygonal.

* * * * *